US009169670B2

(12) United States Patent
Shute et al.

(10) Patent No.: US 9,169,670 B2
(45) Date of Patent: Oct. 27, 2015

(54) DISPOSABLE CABLE LOCK AND DETACHABLE ALARM MODULE

(75) Inventors: Matthew R. Shute, Charlotte, NC (US); Adam Mark Will, Fort Mill, SC (US)

(73) Assignee: Checkpoint Systems, Inc., Thorofare, NJ (US)

( * ) Notice: Subject to any disclaimer, the term of this patent is extended or adjusted under 35 U.S.C. 154(b) by 700 days.

(21) Appl. No.: 12/722,385

(22) Filed: Mar. 11, 2010

(65) Prior Publication Data

US 2010/0231388 A1 Sep. 16, 2010

Related U.S. Application Data

(60) Provisional application No. 61/159,509, filed on Mar. 12, 2009.

(51) Int. Cl.

| | |
|---|---|
| ***G08B 13/12*** | (2006.01) |
| ***E05B 45/00*** | (2006.01) |
| ***E05B 73/00*** | (2006.01) |
| ***G08B 13/14*** | (2006.01) |
| ***G08B 13/24*** | (2006.01) |

(52) U.S. Cl.

CPC ..... *E05B 45/005* (2013.01); *E05B 73/0017* (2013.01); *E05B 73/0029* (2013.01); *G08B 13/1463* (2013.01); *G08B 13/1472* (2013.01); *G08B 13/2434* (2013.01); *G08B 13/2448* (2013.01)

(58) Field of Classification Search

USPC ..... 340/568.4, 568.1, 568.2, 568.3, 571, 340/572.1, 572.8, 10.1, 540, 539.1, 539.11, 340/539.21; 70/57, 57.1, 58, 63

See application file for complete search history.

(56) References Cited

U.S. PATENT DOCUMENTS

| | | | | |
|---|---|---|---|---|
| 1,964,058 | A * | 6/1934 | Holtzman | 70/121 |
| 2,870,239 | A | 1/1959 | Ustin | |
| 2,880,489 | A * | 4/1959 | Burbank | 24/419 |
| 3,116,945 | A | 1/1964 | Blomquist et al. | |
| 3,636,547 | A * | 1/1972 | Brace et al. | 200/85 R |
| 3,929,031 | A | 12/1975 | Webb | |
| 4,061,893 | A * | 12/1977 | Sanner | 200/38 D |
| 4,102,022 | A * | 7/1978 | Aoki | 24/424 |
| 4,400,967 | A | 8/1983 | Owens | |
| 4,515,991 | A | 5/1985 | Hutchison | |
| 4,733,453 | A * | 3/1988 | Jacoby | 29/432 |

(Continued)

FOREIGN PATENT DOCUMENTS

| | | | |
|---|---|---|---|
| WO | WO 98/40591 | A1 | 9/1998 |
| WO | WO 2006/123152 | A1 | 11/2006 |
| WO | WO 2008/057740 | A2 | 5/2008 |

OTHER PUBLICATIONS

International Search Report and Written Opinion for corresponding International Application No. PCT/US2010/027018 mailed Jul. 6, 2010.

(Continued)

*Primary Examiner* — Paul Obiniyi

(57) ABSTRACT

The present invention relates to security devices used to protect merchandise or other objects, including security devices having one or more adjustable cables used to wrap around objects of various shapes and sizes, such that the security devices are secured to the objects. The present invention also relates to a removable module that can enable a disposable, one-alarm passive security device to provide three-alarm functionality.

24 Claims, 19 Drawing Sheets

(56) References Cited

U.S. PATENT DOCUMENTS

| | | | | |
|---|---|---|---|---|
| 4,751,017 | A | 6/1988 | Wachtler et al. | |
| 4,751,350 | A | 6/1988 | Eaton | |
| 4,786,900 | A * | 11/1988 | Karasawa et al. | 340/5.32 |
| 4,957,017 | A | 9/1990 | Corbett | |
| 4,979,382 | A | 12/1990 | Perry | |
| 5,195,860 | A | 3/1993 | Steyn | |
| 5,369,970 | A | 12/1994 | Voiculescu et al. | |
| 5,434,552 | A * | 7/1995 | Ems | 340/431 |
| 5,520,031 | A | 5/1996 | Davidge | |
| 5,541,377 | A | 7/1996 | Stuhlmacher | |
| 5,647,620 | A | 7/1997 | Kuenzel | |
| 5,664,449 | A * | 9/1997 | Sedley | 70/276 |
| 5,667,091 | A | 9/1997 | Slaber, Jr. et al. | |
| 5,689,240 | A * | 11/1997 | Traxler | 340/573.4 |
| 5,711,558 | A * | 1/1998 | Woody | 292/335 |
| 5,722,266 | A * | 3/1998 | Yeager et al. | 70/57 |
| 5,794,464 | A * | 8/1998 | Yeager et al. | 70/57 |
| 5,803,692 | A | 9/1998 | Postadan | |
| 5,842,359 | A | 12/1998 | Longueira | |
| 5,936,530 | A * | 8/1999 | Meinhold | 340/573.1 |
| 5,969,613 | A | 10/1999 | Yeager et al. | |
| 6,092,401 | A * | 7/2000 | Sankey et al. | 70/18 |
| 6,125,669 | A | 10/2000 | McDaid et al. | |
| 6,149,455 | A | 11/2000 | Levi | |
| 6,179,646 | B1 | 1/2001 | Horchler | |
| 6,189,407 | B1 | 2/2001 | Champ et al. | |
| 6,230,526 | B1 | 5/2001 | Fontes et al. | |
| 6,237,375 | B1 * | 5/2001 | Wymer | 70/14 |
| 6,298,695 | B1 | 10/2001 | Vezina et al. | |
| 6,308,928 | B1 | 10/2001 | Galant | |
| 6,388,558 | B1 * | 5/2002 | Emmei | 340/5.2 |
| 6,438,802 | B1 | 8/2002 | Beeman et al. | |
| 6,453,795 | B1 * | 9/2002 | Eicher et al. | 92/23 |
| 6,672,269 | B1 | 1/2004 | Bonde et al. | |
| 6,931,265 | B2 * | 8/2005 | Reyes et al. | 455/566 |
| 6,994,370 | B2 * | 2/2006 | Sabol | 280/618 |
| 7,053,774 | B2 * | 5/2006 | Sedon et al. | 340/568.2 |
| 7,098,792 | B1 * | 8/2006 | Ahlf et al. | 340/568.1 |
| 7,129,841 | B2 | 10/2006 | Feibelman | |
| 7,162,899 | B2 * | 1/2007 | Fawcett et al. | 70/57 |
| 7,168,275 | B2 * | 1/2007 | Fawcett et al. | 70/57 |
| 7,174,752 | B2 | 2/2007 | Galant | |
| 7,227,467 | B2 | 6/2007 | Feibelman | |
| 7,251,966 | B2 * | 8/2007 | Fawcett et al. | 70/57 |
| 7,272,962 | B2 | 9/2007 | Benda et al. | |
| 7,350,381 | B2 * | 4/2008 | Fawcett et al. | 70/57 |
| 7,385,522 | B2 * | 6/2008 | Belden et al. | 340/693.5 |
| 7,403,118 | B2 * | 7/2008 | Belden, Jr. | 340/568.2 |
| 7,446,664 | B2 * | 11/2008 | White | 340/573.1 |
| 7,479,879 | B2 * | 1/2009 | Merrem et al. | 340/568.2 |
| 7,481,086 | B2 * | 1/2009 | Fawcett et al. | 70/57 |
| 7,497,100 | B2 * | 3/2009 | Fawcett et al. | 70/57 |
| 7,497,101 | B2 * | 3/2009 | Fawcett et al. | 70/57 |
| 7,522,048 | B2 * | 4/2009 | Belden, Jr. | 340/568.4 |
| 7,543,466 | B2 | 6/2009 | Loughlin et al. | |
| 7,562,422 | B2 * | 7/2009 | D'Addario et al. | 24/701 |
| 7,659,817 | B2 * | 2/2010 | Conti et al. | 340/568.2 |
| 7,682,100 | B2 * | 3/2010 | Duval | 403/328 |
| 7,685,850 | B2 | 3/2010 | Nilsson | |
| 7,737,846 | B2 * | 6/2010 | Belden et al. | 340/568.2 |
| 7,808,382 | B2 | 10/2010 | Bonato | |
| 7,836,734 | B2 | 11/2010 | Lynch | |
| 7,918,112 | B2 * | 4/2011 | Fawcett et al. | 70/57 |
| 7,936,267 | B2 * | 5/2011 | Pasma | 340/568.2 |
| 7,969,305 | B2 * | 6/2011 | Belden et al. | 340/568.2 |
| 7,984,629 | B2 | 7/2011 | Xiaobin | |
| 8,002,232 | B2 | 8/2011 | Meislahn | |
| 8,087,269 | B2 * | 1/2012 | Conti et al. | 70/14 |
| 8,122,744 | B2 | 2/2012 | Conti et al. | |
| 8,281,626 | B2 * | 10/2012 | Conti et al. | 70/57.1 |
| 2002/0089434 | A1 * | 7/2002 | Ghazarian | 340/988 |
| 2002/0134119 | A1 * | 9/2002 | Derman | 70/58 |
| 2003/0230870 | A1 * | 12/2003 | Sabol | 280/618 |
| 2004/0032333 | A1 * | 2/2004 | Hatt | 340/574 |
| 2005/0051978 | A1 * | 3/2005 | Sabol | 280/14.24 |
| 2005/0242959 | A1 * | 11/2005 | Watanabe | 340/572.7 |
| 2005/0264383 | A1 * | 12/2005 | Zhang | 335/18 |
| 2006/0123856 | A1 | 6/2006 | Loughlin et al. | |
| 2006/0137409 | A1 * | 6/2006 | Fawcett et al. | 70/57.1 |
| 2006/0137411 | A1 * | 6/2006 | Fawcett et al. | 70/57.1 |
| 2006/0145848 | A1 * | 7/2006 | Marsilio et al. | 340/568.2 |
| 2006/0169008 | A1 * | 8/2006 | Fawcett et al. | 70/57.1 |
| 2006/0170550 | A1 * | 8/2006 | Marsilio et al. | 340/568.2 |
| 2007/0039360 | A1 * | 2/2007 | Fawcett et al. | 70/57.1 |
| 2007/0080806 | A1 | 4/2007 | Lax et al. | |
| 2007/0101775 | A1 * | 5/2007 | Fawcett et al. | 70/57.1 |
| 2007/0107477 | A1 * | 5/2007 | Fawcett et al. | 70/57.1 |
| 2007/0120669 | A1 * | 5/2007 | Belden, Jr. | 340/568.2 |
| 2007/0146134 | A1 * | 6/2007 | Belden et al. | 340/571 |
| 2007/0152836 | A1 | 7/2007 | Nagelski et al. | |
| 2007/0159328 | A1 * | 7/2007 | Belden et al. | 340/571 |
| 2008/0034815 | A1 * | 2/2008 | Fawcett et al. | 70/57.1 |
| 2008/0061975 | A1 * | 3/2008 | Belden et al. | 340/571 |
| 2008/0076479 | A1 * | 3/2008 | Nagamine et al. | 455/566 |
| 2008/0169924 | A1 * | 7/2008 | Belden | 340/568.4 |
| 2008/0186550 | A1 * | 8/2008 | Meuwese et al. | 359/197 |
| 2008/0236209 | A1 * | 10/2008 | Conti et al. | 70/18 |
| 2008/0251623 | A1 * | 10/2008 | Goldstein et al. | 242/382 |
| 2008/0303670 | A1 * | 12/2008 | Seidel | 340/572.1 |
| 2008/0316028 | A1 * | 12/2008 | Conti et al. | 340/568.2 |
| 2009/0139615 | A1 * | 6/2009 | Ayada et al. | 148/567 |
| 2009/0158786 | A1 * | 6/2009 | Fawcett et al. | 70/57 |
| 2009/0223260 | A1 * | 9/2009 | Conti et al. | 70/57.1 |
| 2009/0267766 | A1 * | 10/2009 | Pasma | 340/568.2 |
| 2009/0288460 | A1 * | 11/2009 | Zhang et al. | 70/266 |
| 2009/0289798 | A1 * | 11/2009 | Yang | 340/572.8 |
| 2009/0320532 | A1 * | 12/2009 | Bonato | 70/57.1 |
| 2009/0323287 | A1 * | 12/2009 | Patterson | 361/709 |
| 2010/0090830 | A1 * | 4/2010 | Conti et al. | 340/571 |
| 2010/0139336 | A1 * | 6/2010 | Necchi | 70/57.1 |
| 2010/0171621 | A1 * | 7/2010 | Yang | 340/572.9 |
| 2011/0068906 | A1 | 3/2011 | Shafer | |
| 2011/0068921 | A1 * | 3/2011 | Shafer | 340/571 |
| 2011/0094274 | A1 * | 4/2011 | Conti et al. | 70/57.1 |
| 2011/0115632 | A1 * | 5/2011 | Yang | 340/572.8 |
| 2011/0154867 | A1 * | 6/2011 | Fawcett et al. | 70/58 |
| 2011/0199210 | A1 * | 8/2011 | McLean | 340/568.1 |
| 2011/0203327 | A1 | 8/2011 | Fong | |
| 2011/0227706 | A1 * | 9/2011 | Yang | 340/10.1 |
| 2011/0241879 | A1 * | 10/2011 | Fawcett et al. | 340/540 |
| 2011/0254661 | A1 * | 10/2011 | Fawcett et al. | 340/5.61 |
| 2011/0260594 | A1 * | 10/2011 | Yang | 312/297 |
| 2011/0283750 | A1 * | 11/2011 | Will | 70/18 |
| 2011/0283751 | A1 | 11/2011 | Avganim | |
| 2011/0283754 | A1 | 11/2011 | Ezzo et al. | |
| 2011/0308283 | A1 | 12/2011 | Nilsson | |
| 2012/0223838 | A1 | 9/2012 | Conti et al. | |
| 2012/0234055 | A1 | 9/2012 | Bland et al. | |

OTHER PUBLICATIONS

International Search Report and Written Opinion for International Application No. PCT/US2011/034532, mailed Sep. 29, 2011.

* cited by examiner

DISPOSABLE CABLE LOCK AND DETACHABLE ALARM MODULE

CROSS-REFERENCE TO RELATED APPLICATIONS

This patent application claims priority to U.S. Provisional Patent Application No. 61/159,509, filed Mar. 12, 2009, entitled "Disposable Cable Lock with Detachable Alarm Module," which is also hereby incorporated by reference in its entirety.

FIELD OF THE DISCLOSURE

The present invention relates to security devices used to protect merchandise or other objects and, more particularly, to security devices having one or more adjustable cables used to wrap around objects of various shapes and sizes such that the security devices are secured to the objects.

BACKGROUND

Electronic article surveillance (EAS) systems are often used to deter and detect shoplifting. Typically, an EAS security system includes an EAS tag and EAS "gates" located near the doors of a retail establishment. The EAS tag is usually incorporated into a security device that has some mechanism, such as pin and magnet, for attaching it to an article of merchandise or other object.

EAS gates are configured to establish a detection zone, often between gates or within a given distance from a gate, through which a consumer must pass as he or she exits the retail establishment. The gates often include a transmitter, a receiver, and an audio and/or visual alarm. The transmitter is configured to send signals through the detection zone. When an EAS tag enters the detection zone, the EAS tag can respond to the signal being sent by the gate's transmitter. The EAS tag's response can include generating a signal or changing or disturbing the original signal transmitted by a gate's transmitter, which is detectable by a gate's receiver. Upon detecting the EAS tag, the alarm is activated to notify store personnel that someone is trying to exit the retail establishment with merchandise that has an attached EAS tag.

In an EAS system, it is the actual EAS tag that is being detected and not the merchandise itself. Therefore, an EAS system can be circumvented by removing the EAS tag from the merchandise. Consequently, devices having additional, integrated layers of security have been developed to prevent the unauthorized removal or destruction of the EAS element. For example, a security device can be configured to house the EAS tag and attach the EAS tag to the merchandise in a manner that limits the likelihood that a consumer or a would-be thief could tamper with or otherwise remove the EAS tag from the merchandise. While these systems and methods provide a number of benefits, they are improved by the embodiments discussed herein.

BRIEF SUMMARY OF THE DISCLOSURE

The present disclosure is directed to systems, apparatuses, methods and other means for providing a security device structured for attachment to an object. The security device can comprise, among other things, a cable and a main body.

The cable can comprise one or more types of material, including an electrical conductor. The cable can be configured to physically attach the security device to the object. In other embodiments, the security device can include a pin-based attaching mechanism (for protecting articles of clothing), a bottle lock attaching mechanism (for protecting bottles), a keeper or plastic enclosure attaching mechanism (for protecting compact disks, software, cologne, and the like), among others.

The main body can comprise, for example, circuitry, at least one contact, and an attaching mechanism configured to facilitate the mechanical and/or communicative coupling of an alarm module to the main body. The contact can be, for example, an electrical contact, an optical contact, or any other type of contact that can facilitate the transmission and/or reception of a communications signal. The communications signal can be electrical, magnetic, optical, any other type, or a combination thereof. To avoid overcomplicating the discussion, electrical contacts and communications are sometimes referred to herein, however one skilled in the art would appreciate that any type of contacts and/or communications can be used without departing from the spirit of embodiments of the invention.

The main body's circuitry can be configured to function as a passive wireless component, such as an EAS tag, that causes actuation of an external alarm of a gate, in response to receiving a signal from the gate.

The at least one electrical contact can be configured to be electrically coupled with the electrical conductor of the cable. In this regard, the electrical contact can also be configured to facilitate the electrical coupling of the cable to a removable alarm module.

The main body of the security device can further comprise a locking mechanism that secures the cable within the main body. The locking mechanism can comprise one or more of the electrical contact(s).

When the removable alarm module is electro-mechanically coupled to the main body, the security device is sometimes referred to herein as comprising the removable alarm module. Unlike some embodiments of the security device, the removable alarm module can include an independent power source, such as a battery, and an alarm mechanism, such as a speaker and/or light emitting component. The removable alarm module can be configured to actuate the alarm mechanism in response to, for example, the alarm module being removed from the main body without using the proper key or other type of tool. The removable alarm module can also be configured to actuate the alarm mechanism in response to the cable being cut. As yet another example, the removable alarm module can be configured to actuate the alarm mechanism in response to receiving a signal from the circuitry of the main body.

The alarm module can comprise a housing and circuitry. The housing can include an attaching mechanism configured to allow the alarm module to be removably coupled to a security device. Although the alarm module can be configured to attach to a security device, in some embodiments the alarm module lacks any mechanism to be physically attached directly to an article for sale.

The alarm module's circuitry can comprise, for example, the alarm mechanism, one or more electrical contacts configured to electrically couple with the security device's electrical contacts (directly or indirectly), and an independent power source, such as a battery. The circuitry can be configured to receive an input from the security device. The circuitry can be further configured to actuate the alarm mechanism in response to receiving the input from the security device. For example, the alarm module can comprise two electrical contacts, which are both electrically coupled to the circuitry, and wherein the circuitry is further configured to output a signal to the first electrical contact and, in response to failing to receive a corresponding signal from the second electrical contact, actuate the alarm mechanism.

The alarm module's housing can include at least two pieces, namely a top portion and a bottom portion. The alarm module can further comprise an electronics subassembly onto which the circuitry is mounted. The electronics subassembly can then be sandwiched between the top portion and the bottom portion of the housing, wherein the electronics subassembly is configured to rotate independent from the housing. The electrical contacts can be configured to rotate with the electronics subassembly.

The alarm module can further comprise at least one locking pin configured to mechanically lock the alarm module to the main housing or other part of the security device. One or more of the locking pins can be configured to rotate with the housing. One or more of the locking pins can also include a spring and/or be comprised of magnetically permeable material. A magnet can then be used to unlock each spring-loaded magnetically permeable locking pin by, for example, placing the magnet outside the housing, causing the spring to be compressed.

An exemplary method for protecting an object using a security device can comprise providing a main body having circuitry and being configured to receive a removable alarm module; providing the removable alarm module including a local alarm mechanism; and actuating the local alarm mechanism of the removable alarm module in response to detecting unauthorized tampering with the security device. The step of providing the main body can also include providing passive one-alarm functionality (e.g., external gate alarming); and the step of providing the removable alarm module can include providing active two-alarm functionality (e.g., internal security device alarming in response to detecting a gate's broadcast signal and in response to detecting security device damage or tampering).

The method of detecting unauthorized tampering of the security device can comprise, for example, determining that a cable incorporated in the security device has been severed. As another example, the method of detecting unauthorized tampering of the security device can comprise determining that the main body has been damaged. The method can also include actuating the local alarm mechanism in response to a signal being received from the main body. As another example, the local alarm mechanism can be actuated in response to the removable alarm module detecting an alarm condition, such as being located in an unauthorized location, damage to the cable, tampering, among others. The method can also comprise, among other things, sending a wireless signal causing the actuation of an external alarm mechanism.

BRIEF DESCRIPTION OF THE SEVERAL VIEWS OF THE DRAWINGS

Figure 1:
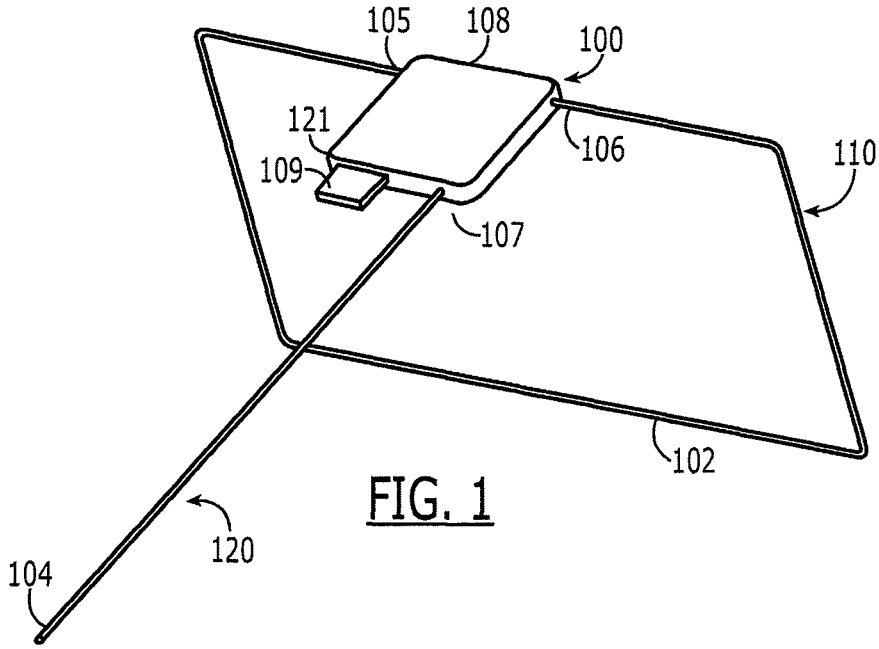
Figure 2A:
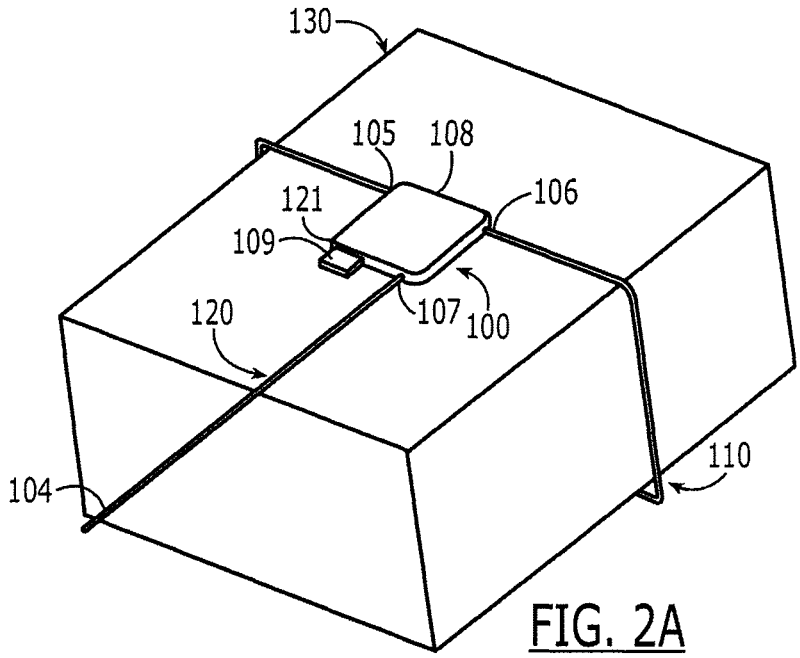
Figure 2B:
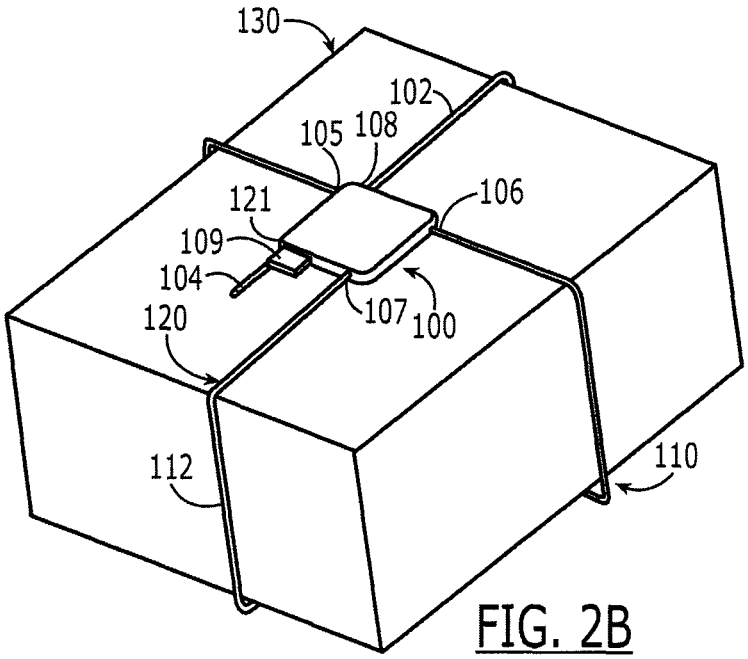
Figure 3:
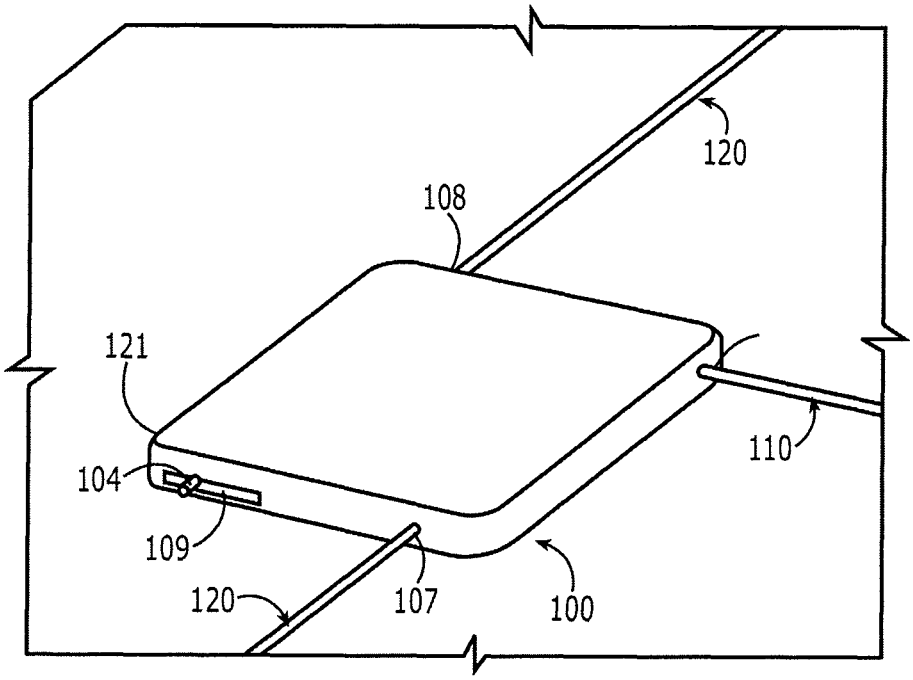
Figure 4:
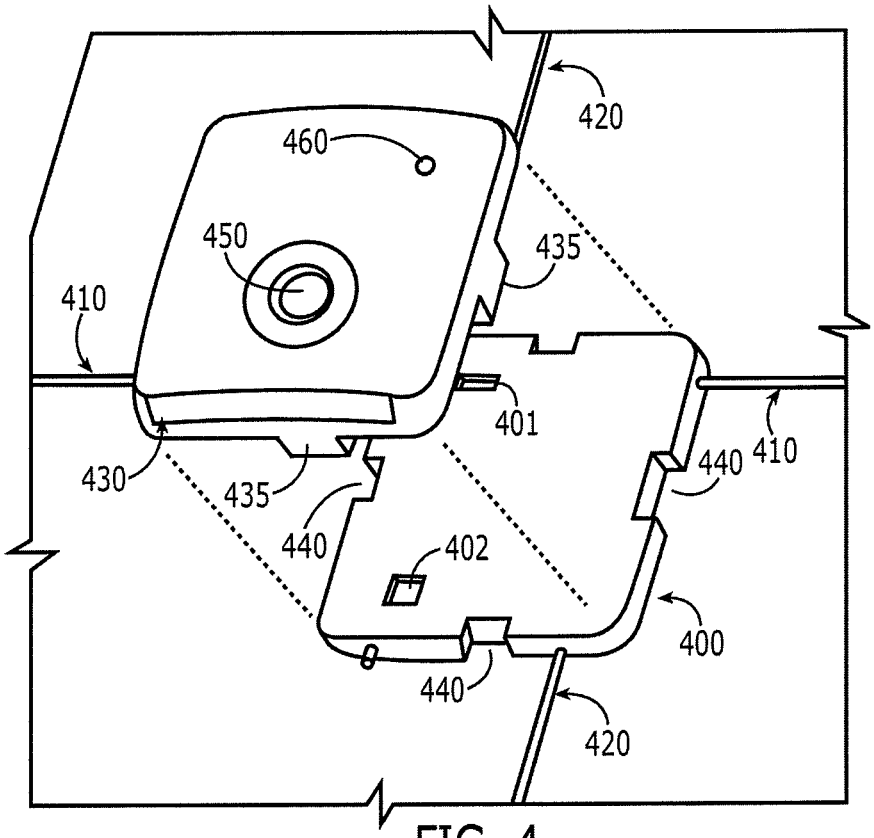
Figure 5:
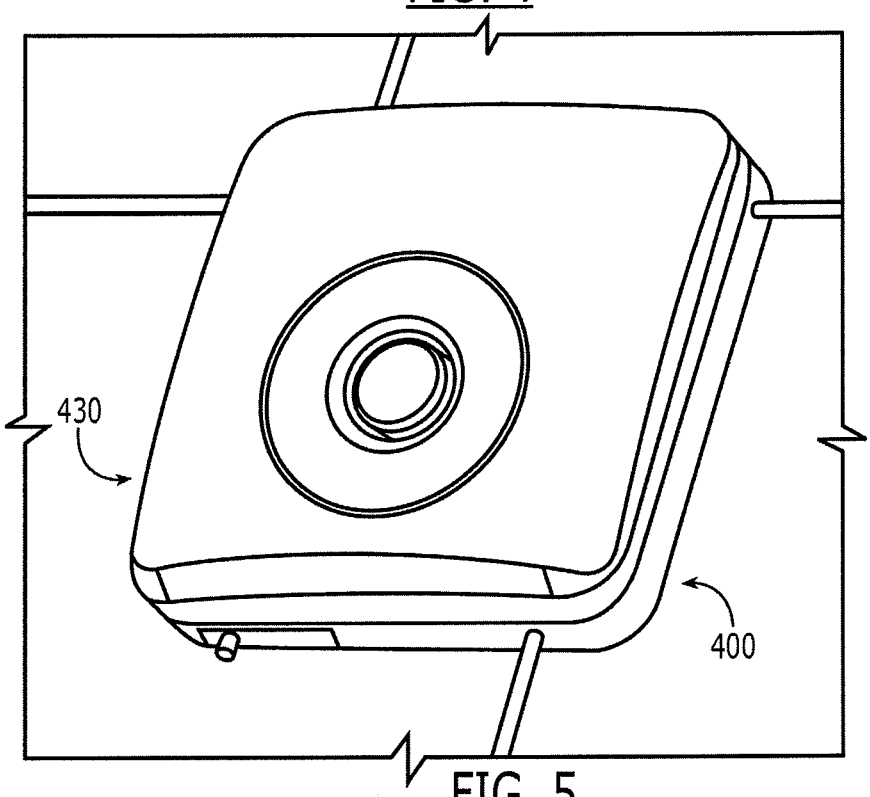
Figure 6:
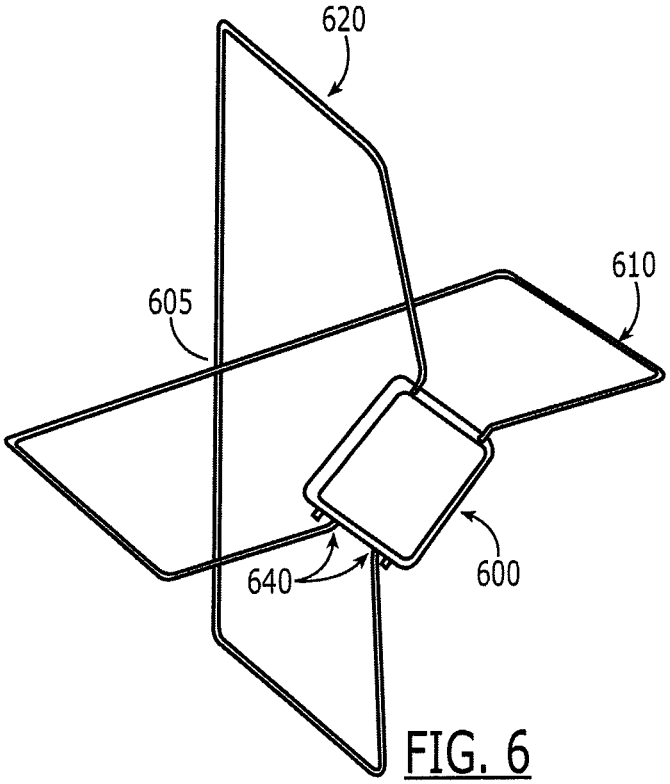
Figure 7:
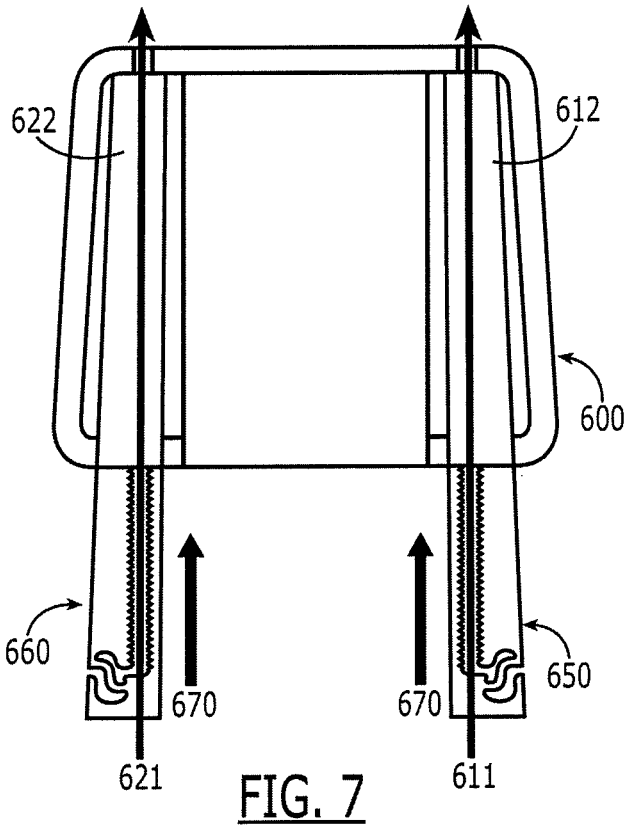
Figure 8:
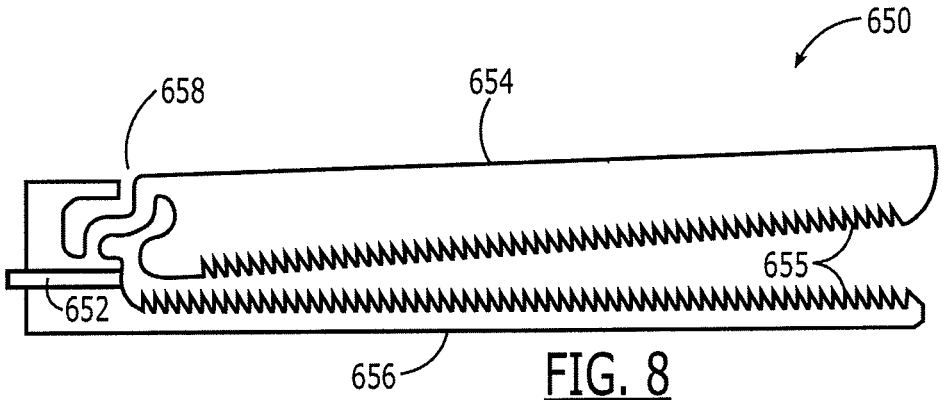
Figure 9:
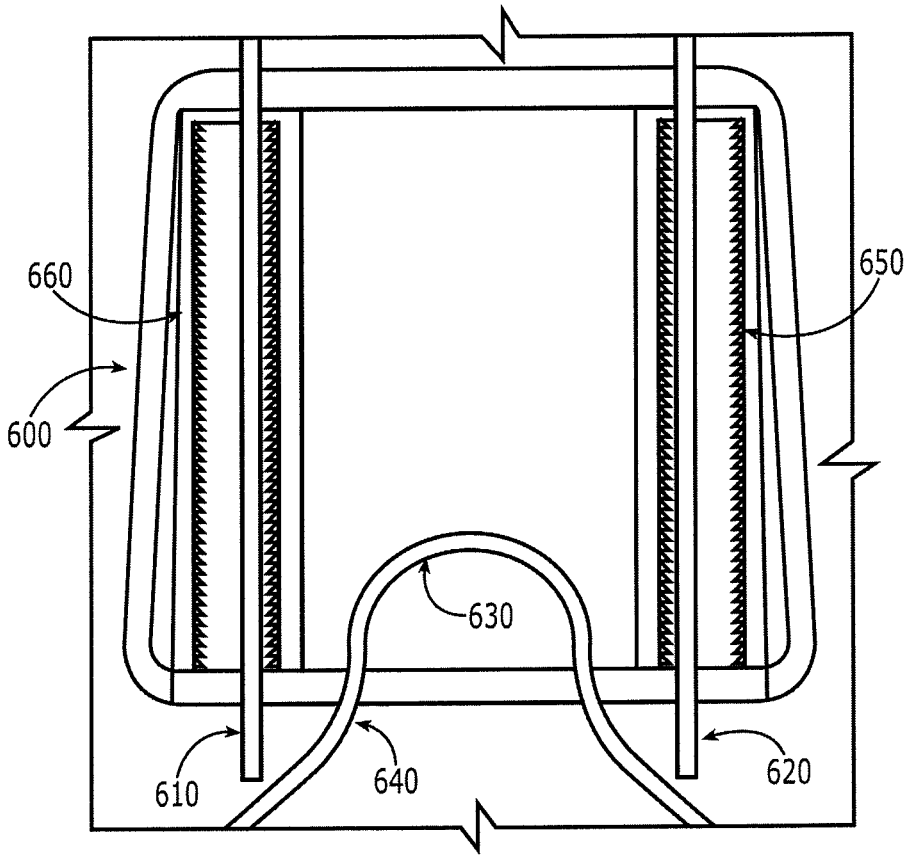
Figure 10:
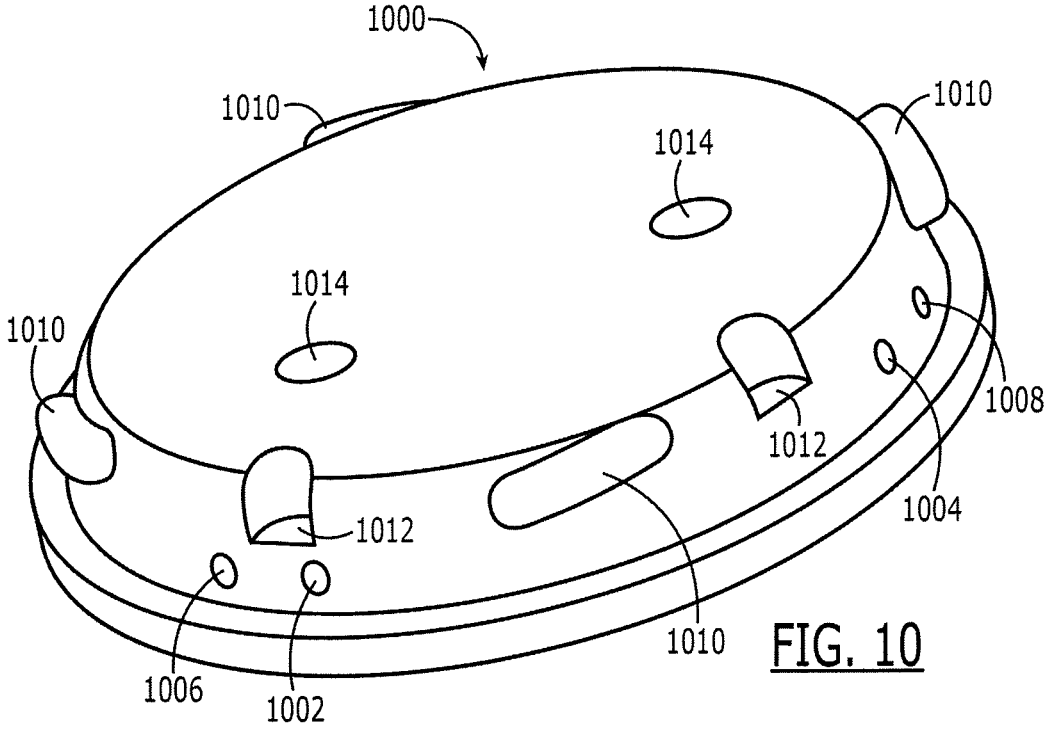
Figure 11A:
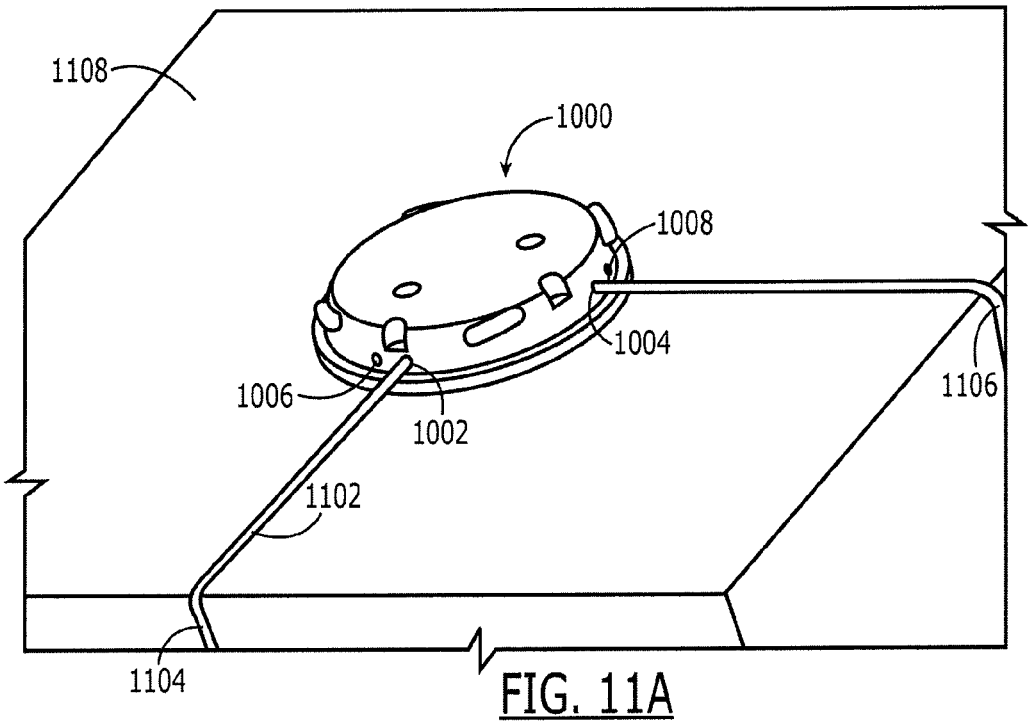
Figure 11B:
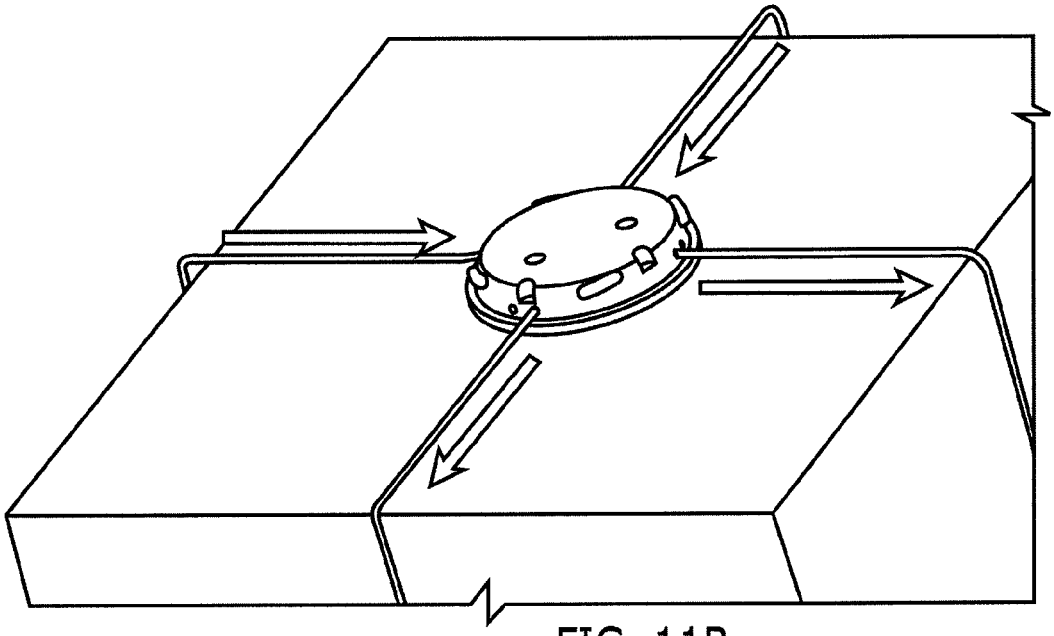
Figure 12A:
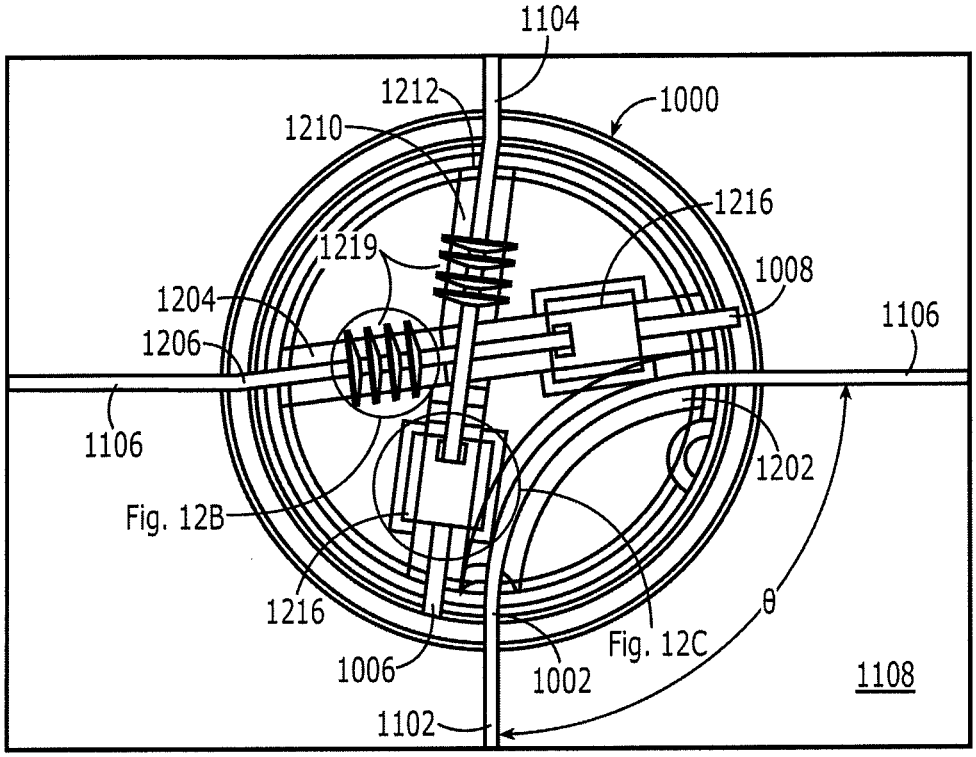
Figure 12B:
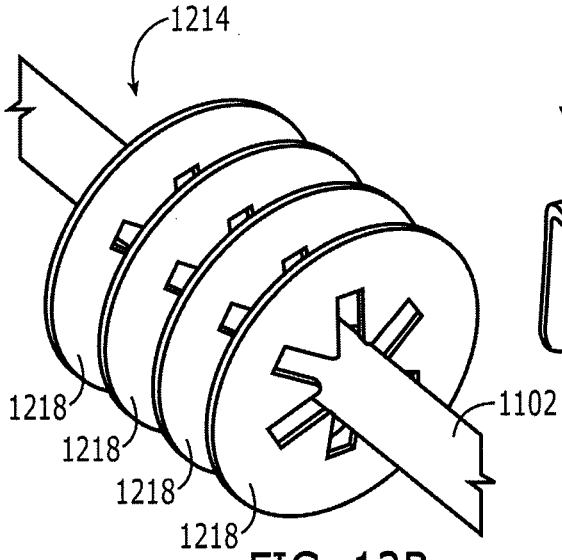
Figure 12C:
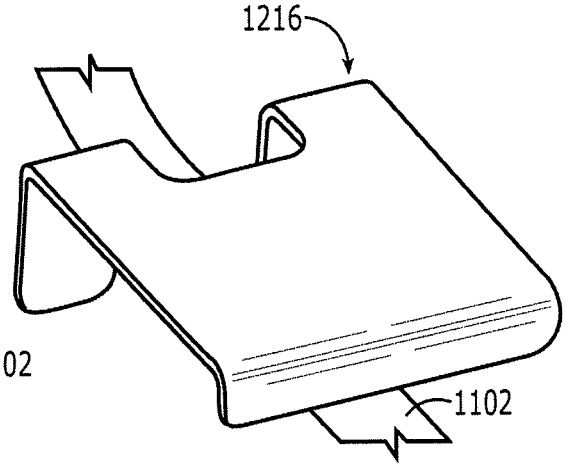
Figure 13:
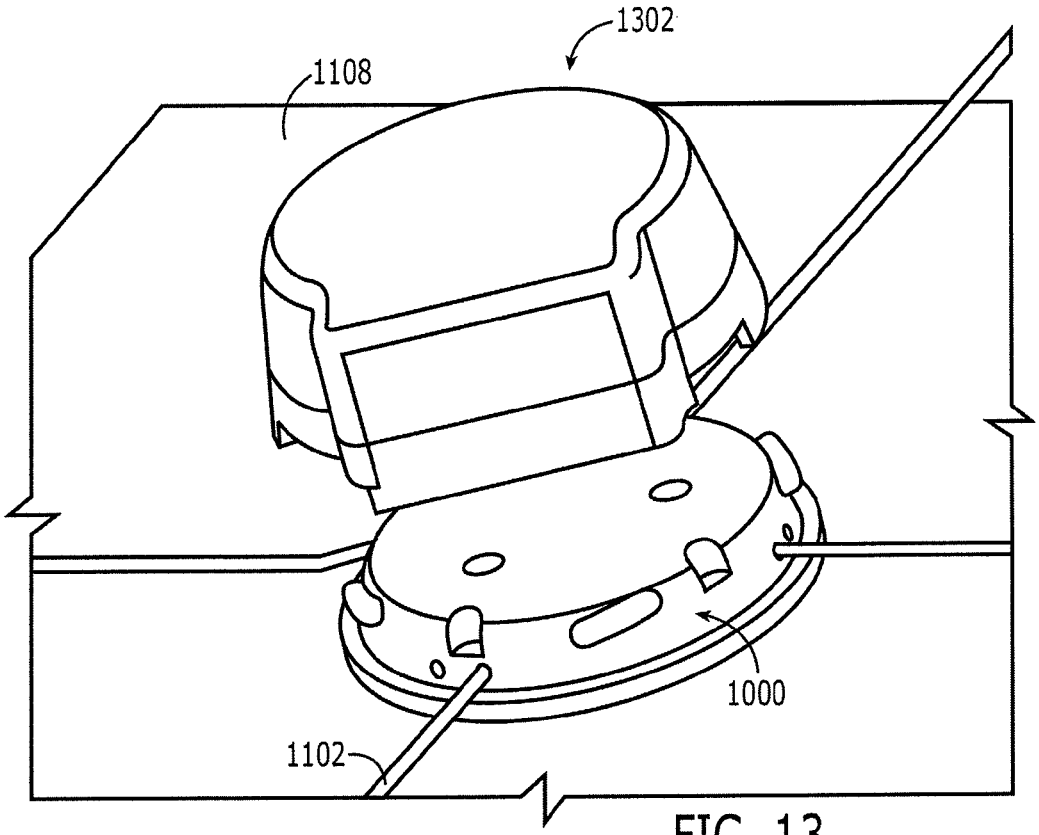
Figure 14A:
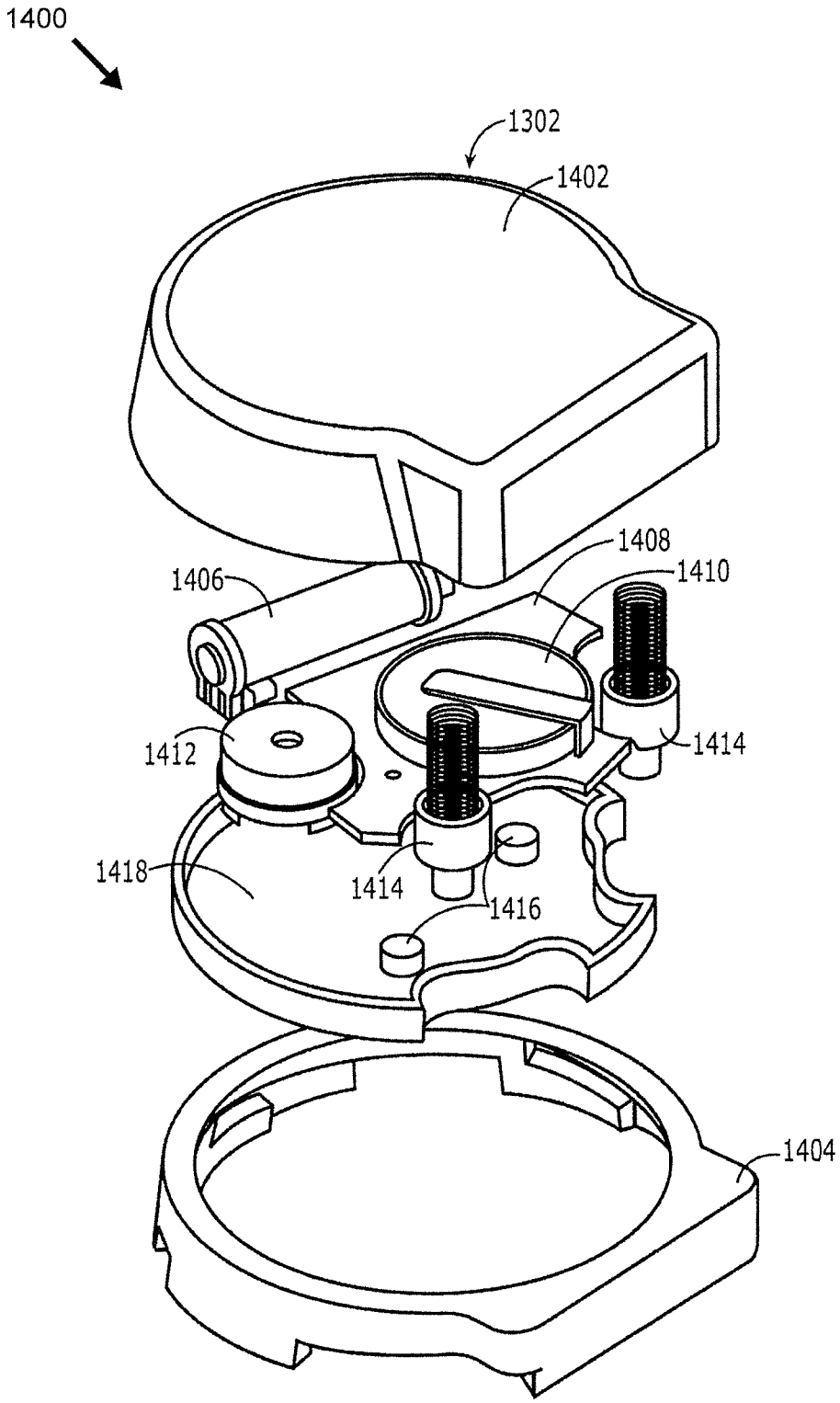
Figure 14B:
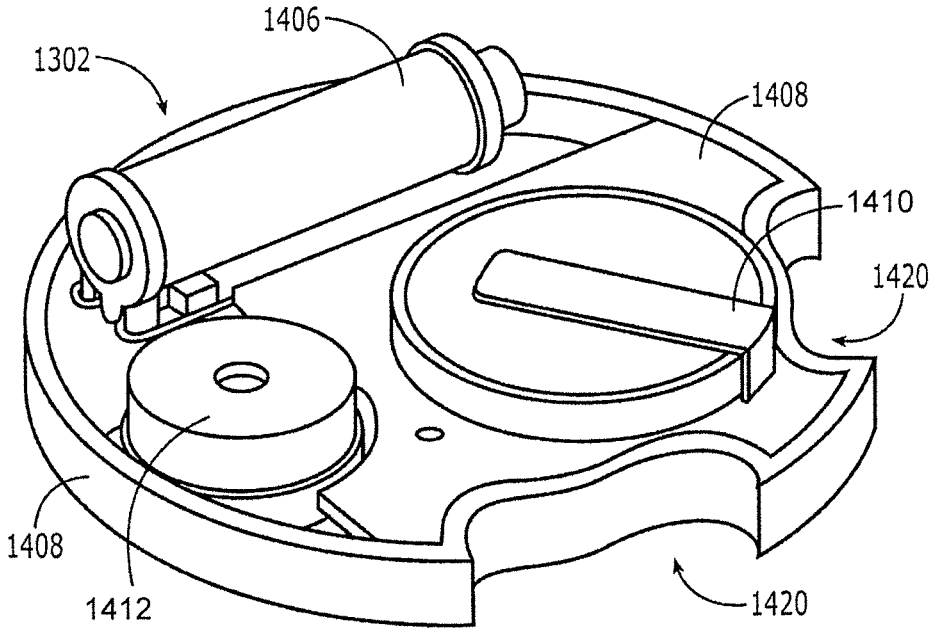
Figure 14C:
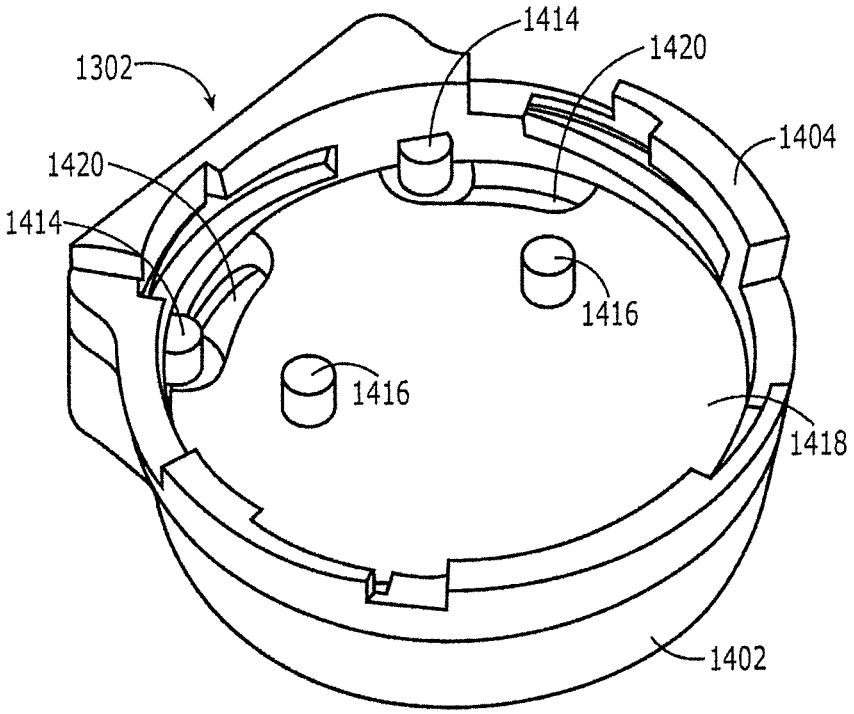
Figure 15A:
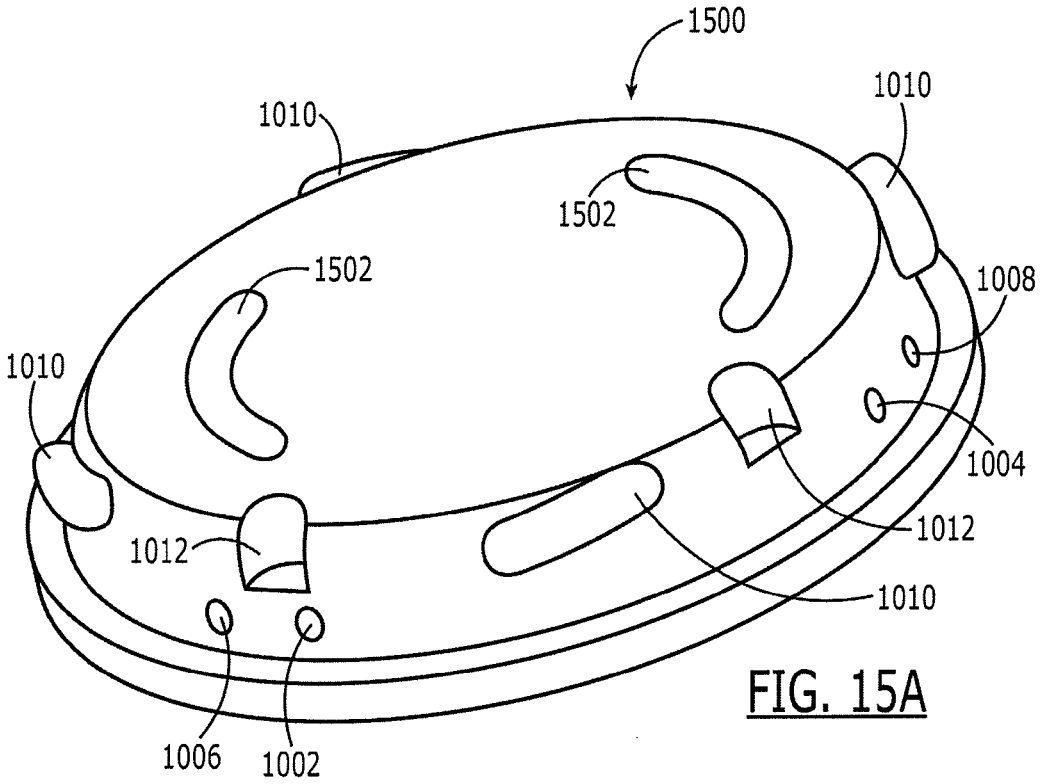
Figure 15B:
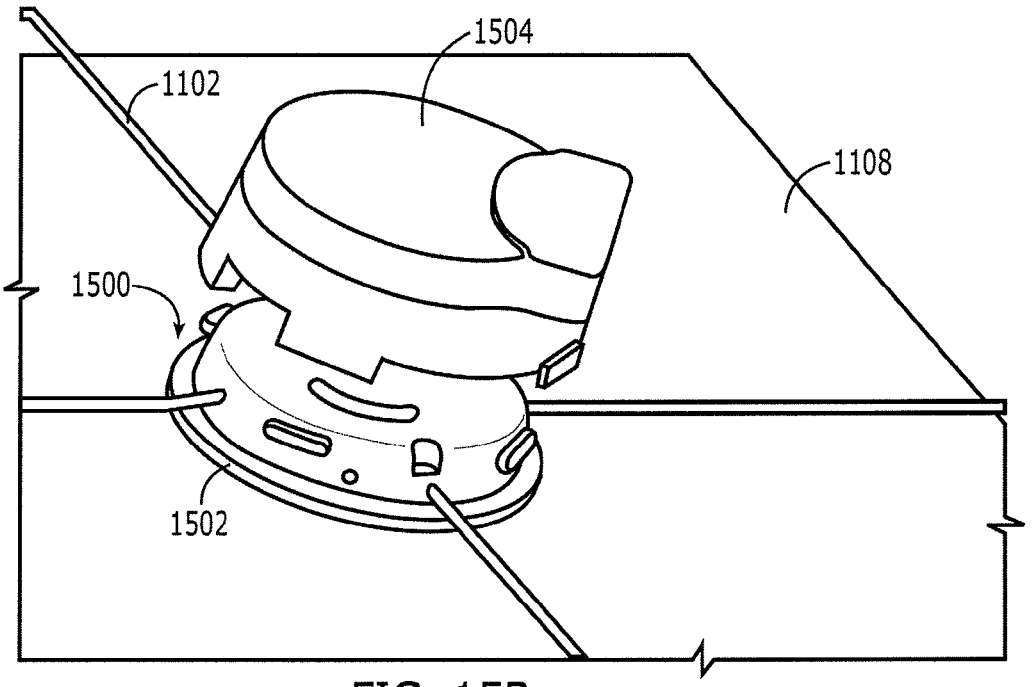
Figure 16A:
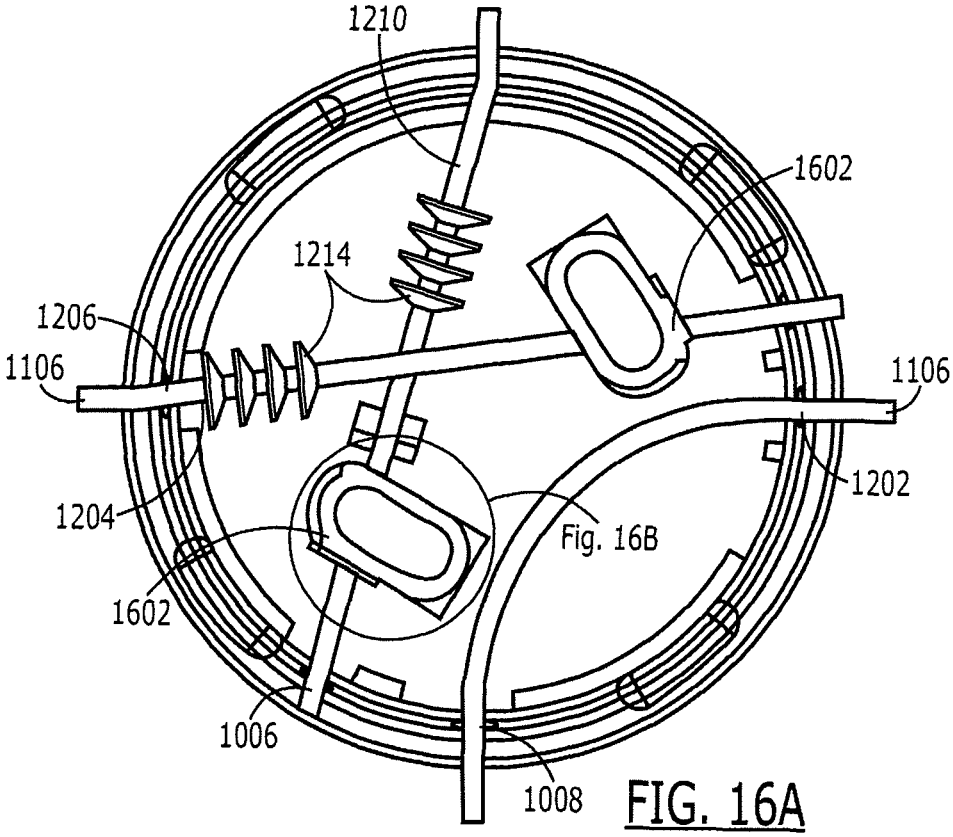
Figure 16B:
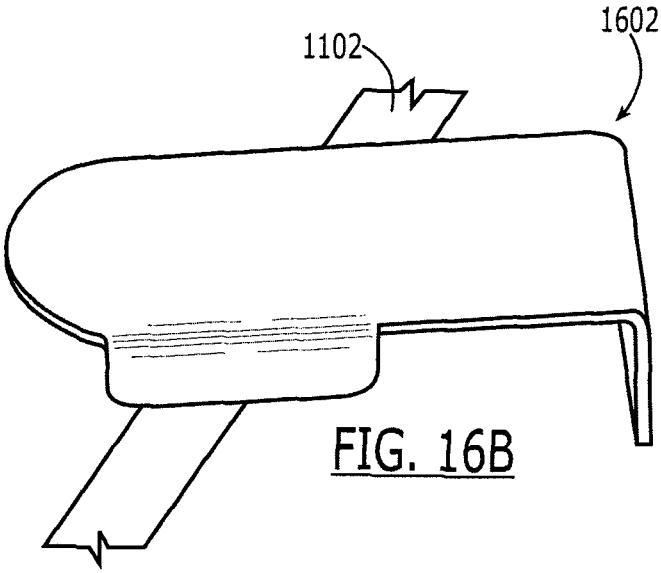
Figure 17:
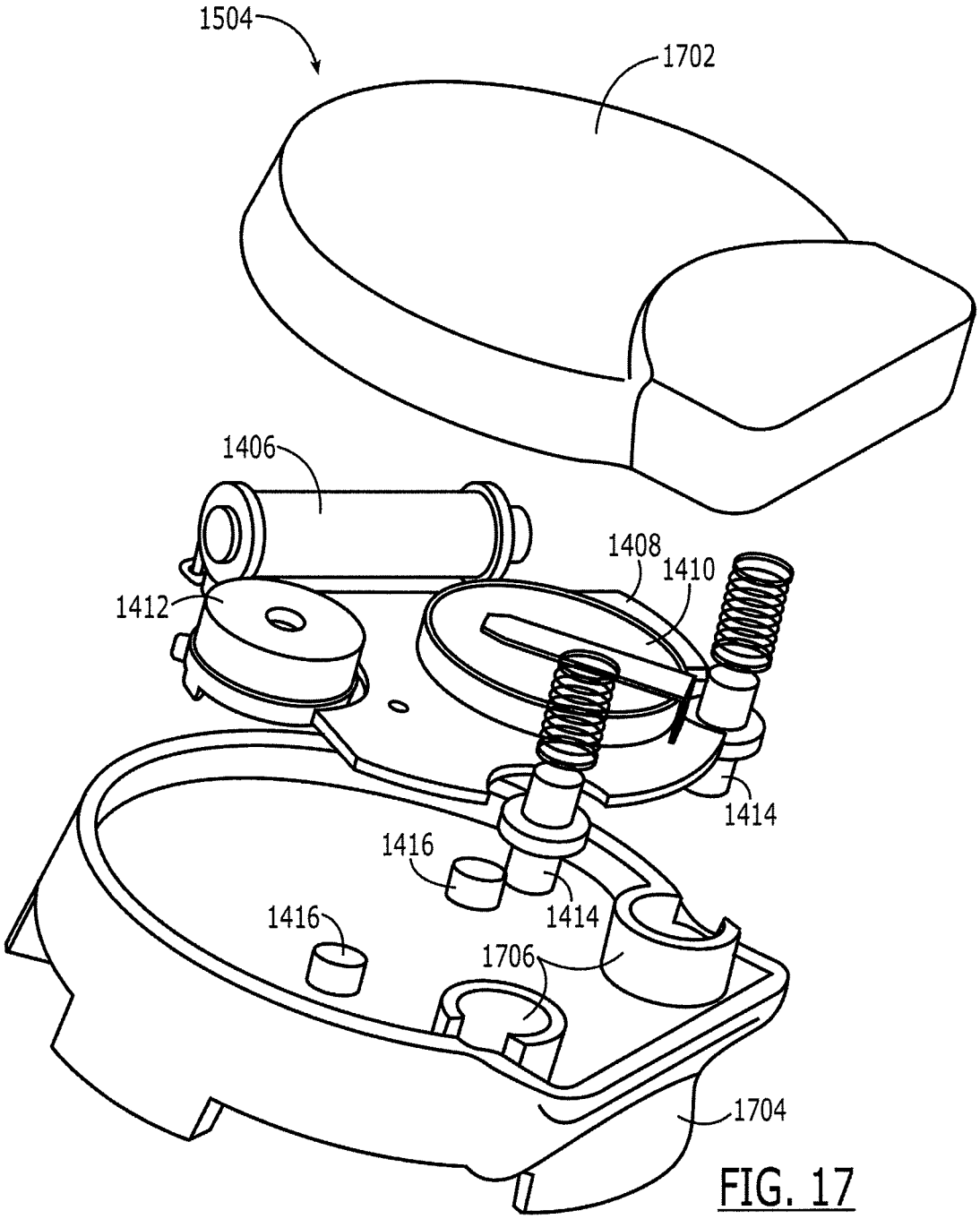
Figure 18A:
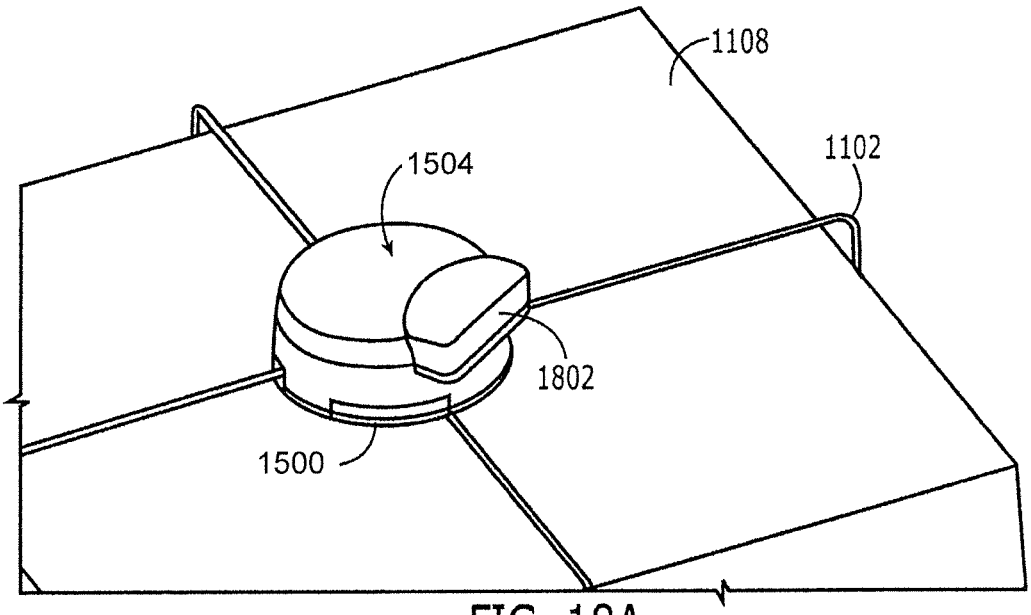
Figure 18B:
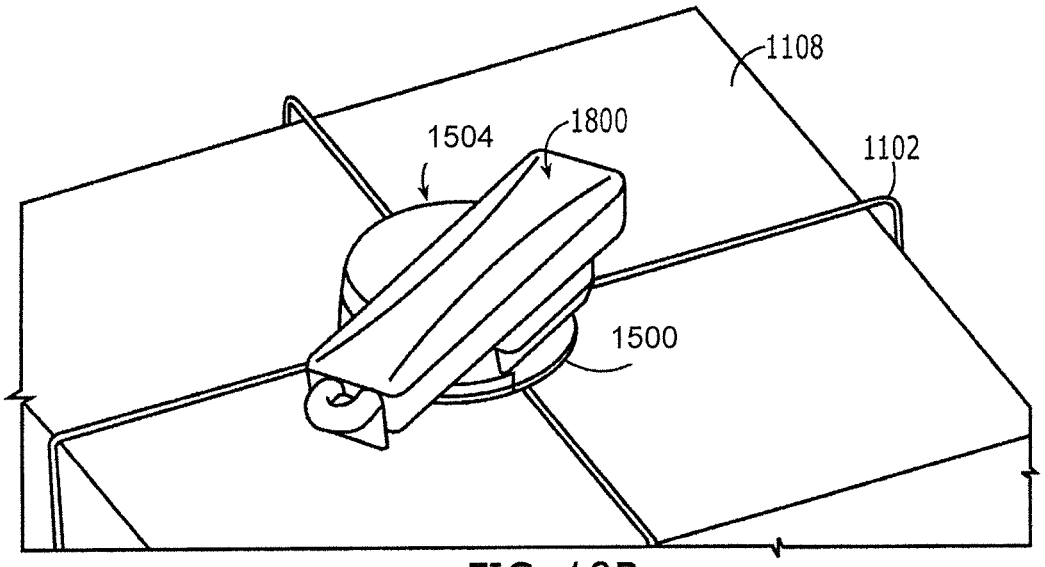
Figure 19A:
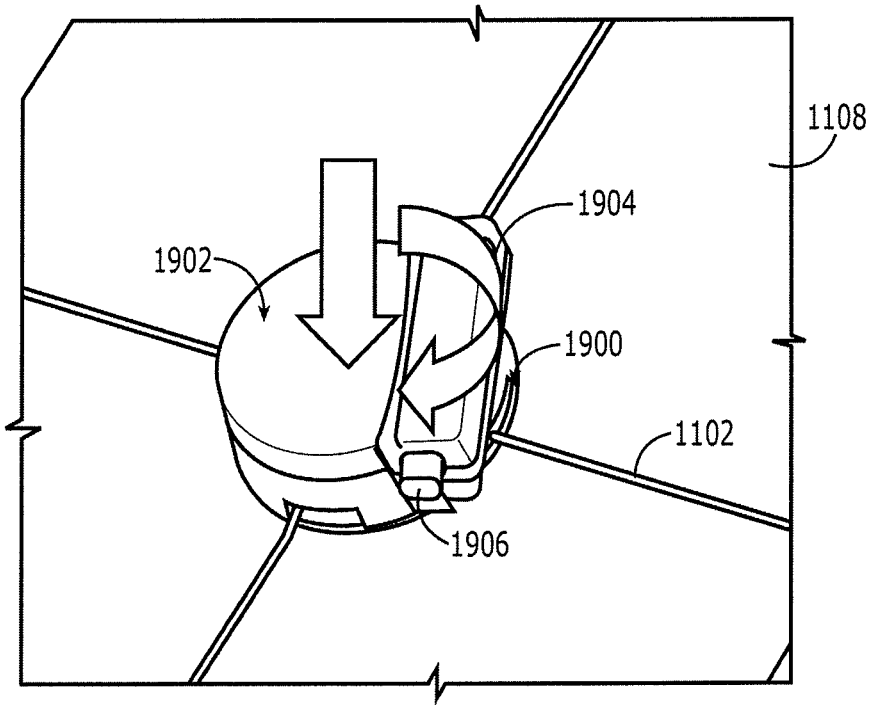
Figure 19B:
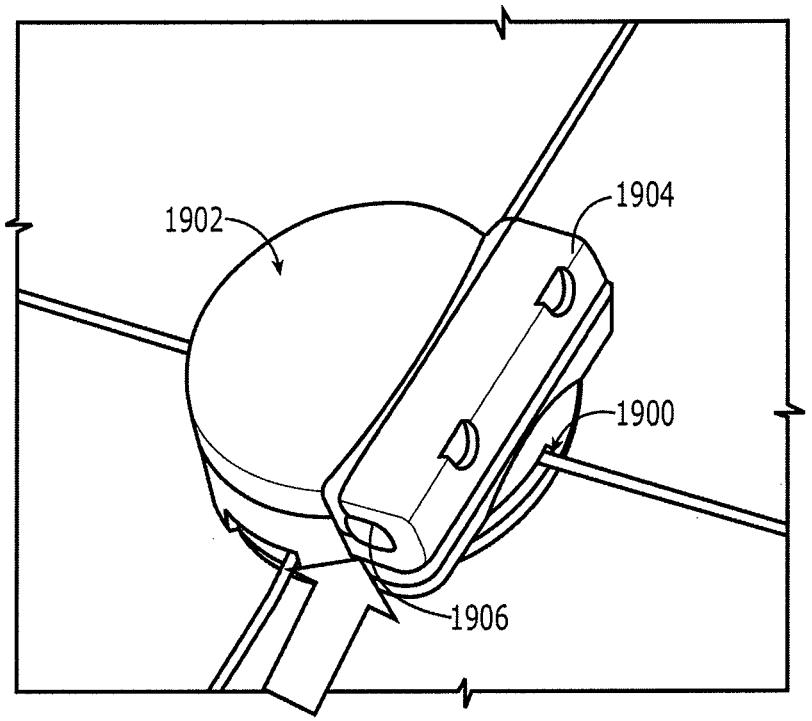
Figure 20A:
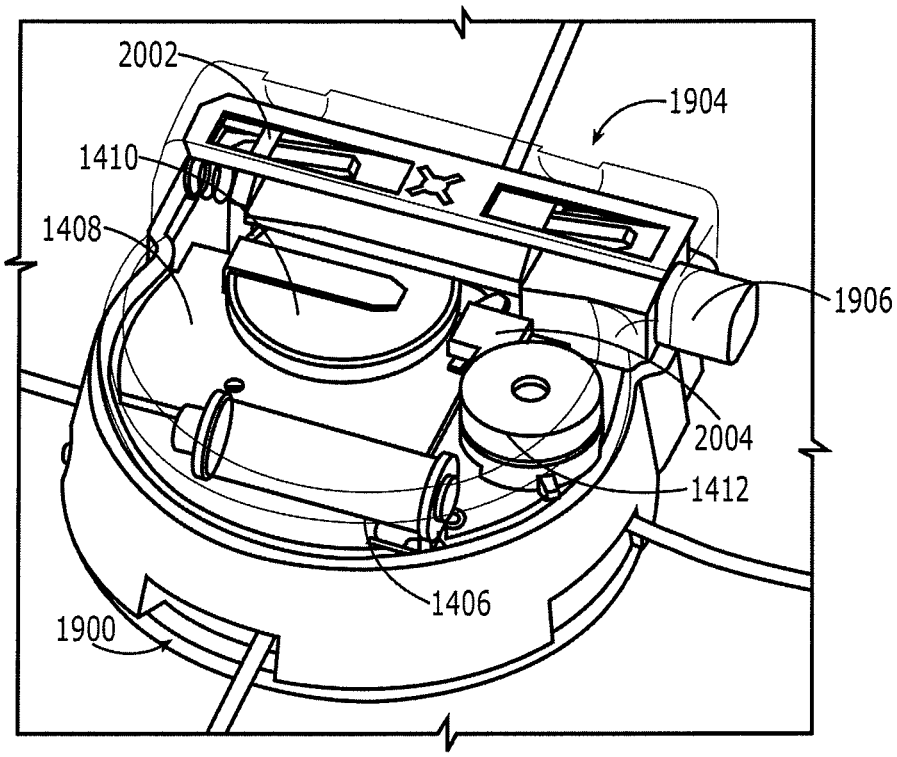
Figure 20B:
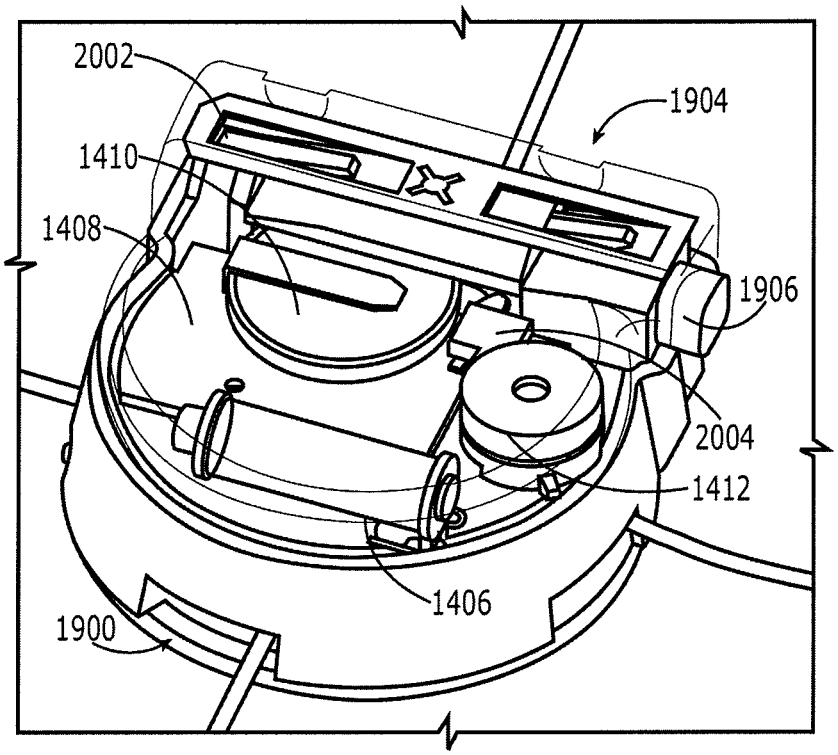
Figure 20C:
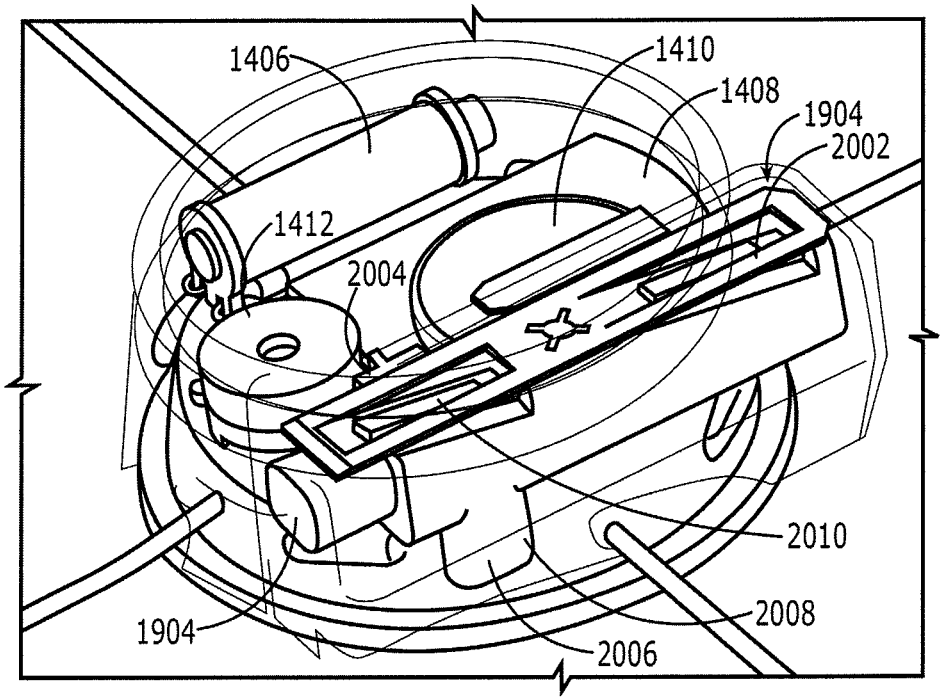
Figure 20D:
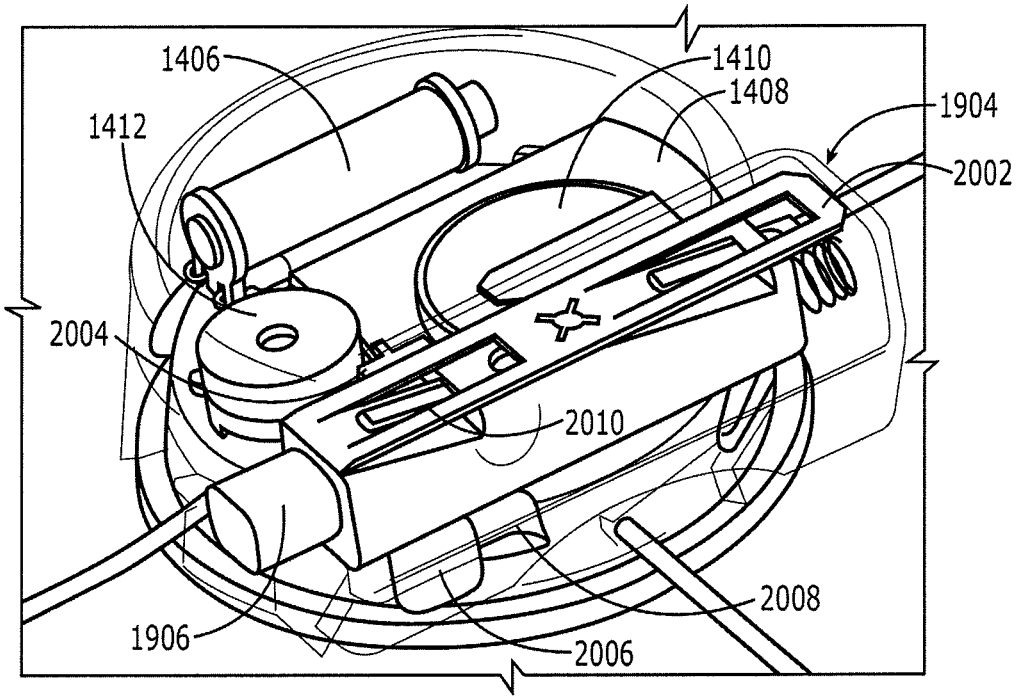
Figure 21:
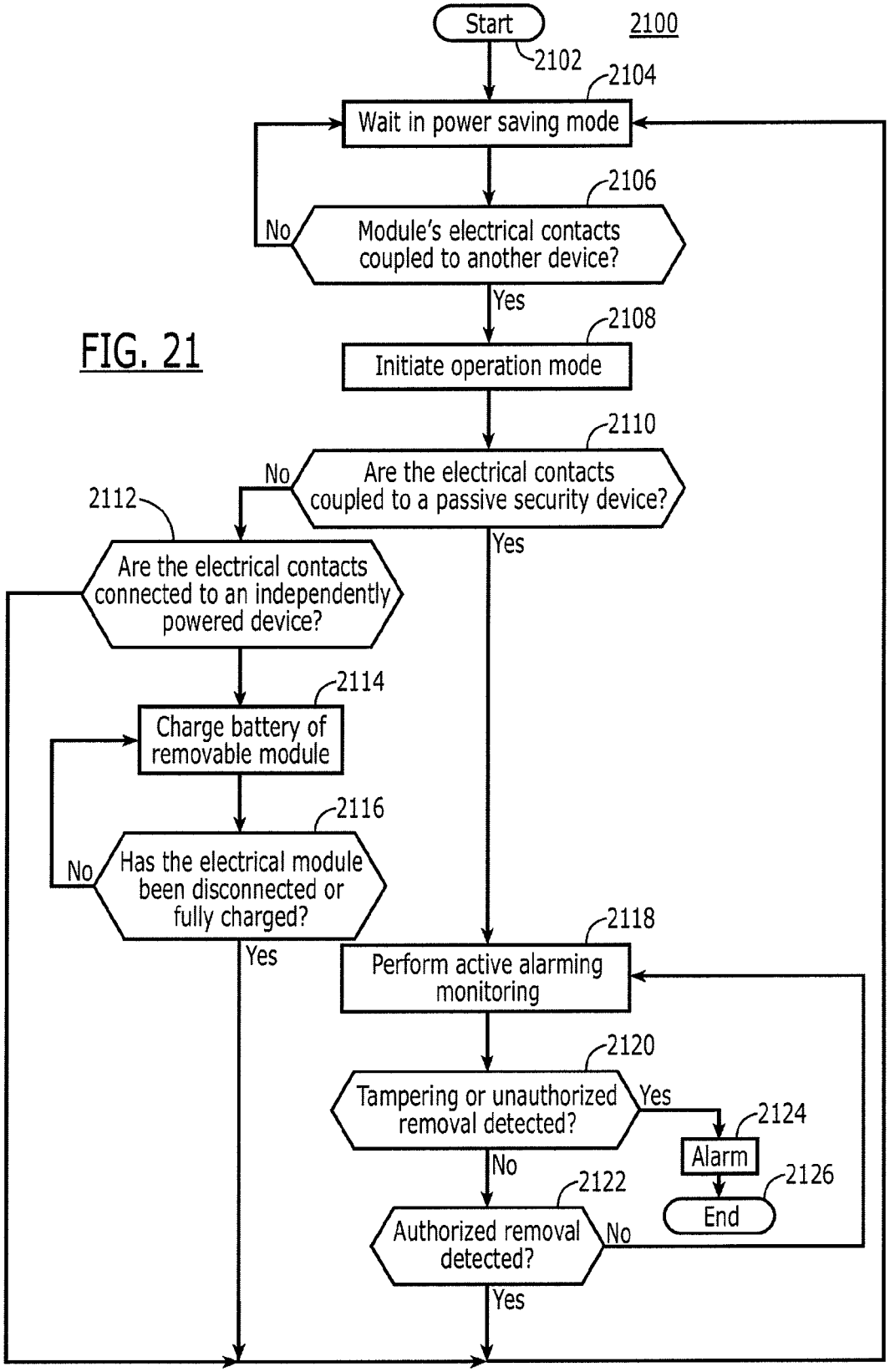

Having thus described the invention in general terms, reference will now be made to the accompanying drawings, which are not necessarily drawn to scale, and wherein:

FIG. 1 is an isometric view of a cable wrap security device according to embodiments of the present invention;

FIG. 2A is an isometric view of the disposable cable wrap security device of FIG. 1 partially attached to an object in which a first loop of the cable is being secured around the object;

FIG. 2B is the isometric view of the disposable cable wrap security device of FIG. 2B attached to the object in which the first loop and a second loop of the cable are being secured around the object;

FIG. 3 is a partial enlarged isometric view of FIGS. 1-2;

FIG. 4 is a partial exploded view of a disposable cable wrap security device attached to an object according embodiments of the present invention;

FIG. 5 is an isometric view of the disposable cable wrap security device of FIG. 4 assembled;

FIG. 6 is an isometric view of a disposable cable wrap security device according to embodiments of the present invention;

FIG. 7 is a partial plan view of the disposable cable wrap security device according to the embodiments of FIG. 6;

FIG. 8 is a plan view of a exemplary securing insert of the disposable cable wrap security device of FIG. 7;

FIG. 9 is a partial plan view of the disposable cable wrap security device according to the embodiments of FIG. 7 as fastened and secured to an object;

FIG. 10 is an isometric view of a main body of a puck security device according to some embodiments;

FIGS. 11A and 11B show isometric views of the puck security device in the form of a disposable wrap security device being used to secure an object according to embodiments of the present invention;

FIG. 12A shows partial plan view of the puck security device according to the embodiments of FIGS. 10, 11A and 11B;

FIGS. 12B and 12C show a detailed view of components included in FIG. 12A;

FIG. 13 shows the puck security device receiving a removable alarm module in accordance with some embodiments;

FIGS. 14A, 14B and 14C show a partial plan view of the alarm module according to the embodiments of FIG. 13;

FIGS. 15A and 15B show an isometric view of a main body of another exemplary embodiment of a puck security device by itself and receiving a removable alarm module in accordance with some embodiments;

FIGS. 16A and 16B show a detailed view of components included in the puck of FIGS. 15A and 15B;

FIG. 17 shows a partial plan view of the alarm module according to the embodiments of FIG. 15B;

FIGS. 18A and 18B show a security system in accordance with the embodiment of FIGS. 15A and 15B coupled together and being removed with a key device;

FIGS. 19A and 19B show an isometric view of a removable security module attached to a puck device in accordance with some embodiments;

FIGS. 20A-20D show detailed views of components included in the puck device and removable security module of FIGS. 19A and 19B; and FIG. 21 shows a machine-implemented process that can be employed by circuitry of an alarm module and/or security device in accordance with some embodiments.

DETAILED DESCRIPTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Embodiments of the present invention provide a security device, among other things. The security device can include at least one cable and/or wire which may encircle all sides of a box, package, book, or other similar structure. It is possible to secure the security device to other packages having other shapes, sizes, and configurations as will be appreciated by one of ordinary skill in the art; however a six-sided package is the configuration most commonly used with a Spider Wrap® at this time, and is therefore shown in some of the drawings. The cable or cables of the security device extend from a main housing of the security device, encircle the object to be secured, and terminate at the main housing. The main housing is configured to maintain cable alignment and secure the cable or cables at a desired length.

A feature of this invention includes providing a security device that is easily adjustable to accommodate objects of varying sizes and shapes. The security device may have a main housing, sometimes referred to herein as a main body, that secures the cable at a desired length and cannot be removed without destruction of the cable or the main body. In this regard, the security device or at least a portion thereof is considered "disposable." The main body may contain an EAS tag. As used herein, an EAS tag includes, among other things, circuitry that is responsive to an acousto-magnetic field, RFID tag, microwave-responsive circuitry, and/or any other wireless device that can be configured to actuate and/or trigger the actuation of an alarm at a security gate should a potential theft attempt be detected (e.g., determining that the object is leaving the premises before removing and/or deactivating the security device from the protected object).

A further feature of the present invention is to provide an active security module, which may take the form of a removable, battery powered module, that is configured to provide additional alarm functionality to a passive (e.g., parasitic) security device. The active alarm portion may be removable from the main body of the security device by application of a key or other type of tool, which may utilize physical, magnetic, electrical and/or any other means to unlock the removable module from the disposable main body.

For example, the active security module can include an integrated audible alarm, including a speaker and/or visual indicator. The audible alarm may be actuated in response to, for example, the integrity of the cable loop of the security device being jeopardized or severed. In addition to or instead of responding to the destruction of the cable loop, the audible alarm can be configured to actuate in response to an EAS tag of the passive security device being activated. The integrated audible alarm of the security device may also be activated when the security device is in relative proximity to a specific location such as the exit of a retail establishment. The security device is sometimes referred to herein as a "three-alarm security device" when the security device provides three types of alarming functionality (e.g., passive gate alarming, active tamper alarming, and active gate alarming), which are each discussed in more detail herein.

These features and others may be obtained by embodiments of the security device described herein, the general nature of which may be stated as comprising a cable for placement about an object to be secured, a locking member including a main body, and a securing insert wherein once the securing insert is engaged within the main body, the length of the cable is locked and the security device may be removed only by destruction of either the cable or the main housing.

An exemplary embodiment of the security device is shown in FIGS. 1-3. The main body 100 contains a single cable extending from a first end 105 to a second end 104. The first end 105 is secured to the main body 100. In some embodiments, cable 102 is comprised of metal or includes a conductive material. In other embodiments, the cable 102 can lack any conductive material and/or otherwise comprise any material having any suitable properties, including plastics, carbon fibers, nylon, among others.

The first end 105 of the cable 102 is secured within the main body 100 such that the first end 105 is not accessible or removable (without, e.g., damaging or destroying the main body 100). The cable 102 forms a first loop 110 extending from the first end 105 and is threaded around and back through the main body at the opening 106. The cable 102 is then routed back out of the main body at opening 107. As shown in FIG. 2A, the first loop 110 can be placed around the object 130. In addition to or instead of inserting object 130 into the first loop 110, the first loop 110 can be formed around the object 130 by first placing main body 100 on the object 130 and then wrapping cable 102 around object 130. As the cable portion 120 is pulled, the first loop 110 narrows, thereby tightening the main body 100's and other components of the security device's physical attachment to the object 130. As the first loop 110 is pulled, cable portion 120 is shortened. In this regard, the cable 102 of the security device can provide adjustability allowing the security device to secure a variety of objects having a variety of shapes and sizes.

As shown in FIG. 2B, the cable 102 can then be threaded around the object 130 at least one more time and inserted into a receiving opening 108 of the main body 100. For example, if the cable 102 is wrapped around the object 130 one additional time, the cable 102 thereby forms a second loop 112. The second end 104 of the cable 102 is then routed through the main body 100 and out of the main body 100 at opening 121 and through a securing insert 109 as shown in FIG. 3. As the second end 104 of the cable 102 is pulled through and away from the main body 100, the second loop 112 narrows. As the second loop 112 is pulled, the second end 104 of the cable is pulled closer or into the main body 100.

The second end 104 of the cable 102 is pulled until the desired tension is achieved around the object to be secured, such that the security device cannot be removed from the object without damaging or breaking some part of the security device. The securing insert 109 is then pressed into the main body 100, whereupon the securing insert 109 locks the cable portion 120 at the desired length as shown in FIG. 3. Excess cable length, at the second end 104, may be trimmed back to the securing insert 109 to provide a more pleasing aesthetic appearance and/or reduce the likelihood of an exposed sharp cable end.

In some embodiments, including those shown in FIGS. 1-3, the openings 108 and 109 can be positioned such that the cable 102 has a straight path through main body 100, or at a least relatively straight path (as compared to, e.g., the path from the opening 106 to the opening 107. One advantage realized by the relatively straight path through main body 100 is that it would be easier for a user to insert the second end 104 into main body 100 and push it through until it comes out opening 109. Although it may be harder to push the cable 102 through the main body 100 with a bend or turn (as would be required between openings 106 and 107), the manufacturer, supplier or other entity may provide the security device to the end user with the first loop 110 pre-formed.

Embodiments of the present invention may include an EAS tag (e.g., ultra-high frequency RFID tag), and/or other wireless component secured within the main body 100. While not shown in FIGS. 1-3, such a device should be apparent to one of ordinary skill in the art and additional examples of which are discussed elsewhere herein. The EAS tag may passively or actively serve to actuate an alarm at a security gate within a retail establishment or other desired location.

FIG. 4 shows the security device in accordance with an embodiment that is configured to include an alarm module 430, which can provide one or more additional levels of security as may be desired with more expensive or more commonly stolen articles. The alarm module 430 may be removably fastened to main body 400. For example, as shown in FIG. 4, the removable alarm module 430 can include attaching components 435, which can be received by notches 440 of the main body 400. The removable alarm module 430 may be configured to include an internal speaker, such as a piezo electric speaker 450, that can generate an audible alarm when triggered. The removable alarm module 430 may further be configured with a visual interface component, such as LED 460, to serve as an additional theft deterrent and/or to show that the alarm module and/or security device is activated and/or functioning properly.

The cable wrap security device may be of an embodiment as described above with respect to FIGS. 1-3 and further comprising electrical connection pads 401 and 402 as shown in FIG. 4. The electrical connection pads are electrically coupled to and, in some embodiments, facilitate electrical communication between 410 and 420 used to secure the object. The cable shown in FIG. 4, like any other cable discussed herein, can comprise, for example, an electrically conductive material (such as a braided metal or wire) surrounded by an insulator (such as a plastic sheath). One skilled in the art would appreciate than any signal-carrying medium can be used in addition to or instead of an electrically conductive material, including, e.g., optical fiber, conductive films, conductive tape, straps, among others. (As used herein, "signal-carrying medium" refers to material adapted to facilitate the transmission of a signal along a defined path.)

The removable alarm module 430 may have complementary contacts, such as connection pads (not shown), that contact the electrical connection pads 401 and 402, located on the external portion of the main body 400. The connection pads of the removable alarm module 430 can be configured to contact the electrical connection pads 401 when, as shown in FIG. 5, the removable alarm module 430 is attached to the main body 400. The external electrical connection pads 401 and/or 402 are electrically coupled to at least one electrical contact (not shown) internal to the main body 400. The internal electrical contact can be electrically coupled to the conductive portion(s) of the cable loops 410, 420. As such, this configuration requires the cable to be in electrical contact to complete a circuit between the electrical connection pads 401 and 402.

The removable alarm module 430 may be configured to sense when one or both of the cable loops 410 and 420 are compromised. Such a configuration may include, for example, circuitry within the removable alarm module 430 that is configured to send one or more electrical pulses (e.g., a pulse signal) between the electrical connection pads 401 and 402 and/or maintain a voltage (digital signal) above a certain threshold (e.g., 2.5V DC) between the electrical connection pads 401 and 402. If the signal is sent by the first electrical connection pad 401, but the second electrical connection pad 402 fails to receive the same signal, circuitry of the removable alarm module 430 can be configured to trigger the alarm module's audio and/or visual alarm(s). For example, the electrical pulse would not be received at the second electrical connection pad 402 and the alarm of the alarm module 430 would be activated in response to either of the cable loops 410 or 420 being severed or broken.

The circuitry of removable alarm module 430 may further be configured to detect and trigger its audio and/or visual alarm in response to an EAS component of the main body 400 entering and/or maintaining a passively excited or activated state. Such embodiments may be realized by incorporating an antenna (not shown) into the removable alarm module 430 that detects an excited state of the EAS tag. As another example, the main body 400 may include its own EAS tag and/or other component (not shown) that, when activated, sends a signal via one or more of the electrical connection pads 401 and/or 402. There are other configurations and methods that can be implemented by the main body 400 to trigger the alarming components of the removable alarm module 430 when the two are in close proximity (e.g., electrically and/or mechanically coupled together), such as shown in FIG. 5, which will be appreciated by one of ordinary skill in the art. Such embodiments may be particularly useful for providing three alarm functionality to a passive device, as further described herein.

In some embodiments, the removable alarm module 430 may be configured to detect, independent of any functionality of the main body 400, when the alarm module is proximate to a security gate (e.g., between two sensors or within a given distance from a sensor. For example, some embodiments of the removable alarm module 430 may include a ferrite element that may be triggered and or excited by a magnetic field around the security gate. As another example, a security gate can create a local acousto-magnetic field that is detected by logic circuitry and triggers an alarm within the removable alarm module 430. Other examples include electronic security gates that create, and security devices that are triggered by, radio frequency signals and microwave signals. The alarm module may then activate its alarm so that a person carrying the alarm device may be distinguished from other nearby people.

Alarm module 430 may be configured to switch between an operational state, when attached to the security device 300, and an inactive state, typically when detached from a security device. For example, when the circuitry of the removable alarm module 430 detects that its connection pads are uncoupled, the circuitry of the removable alarm module 430 may enter a sleep or power saving mode, where at least some the functionality of the removable alarm module 430 is powered OFF or otherwise disabled. In response to determining its connection pads are coupled together (e.g., via electrical connection pads 401 and 402 of main body 400), the circuitry can be powered ON and the module function accordingly.

The removable alarm module 430 of FIG. 4 may be configured to attach to the main body 400 of the security device 300 with a latch or other type of mechanism (discussed in connection with. E.g., FIGS. 14A-14C) in addition to or instead of attaching components 435. The latch mechanism may be configured to be released only when a security key is applied to the removable alarm module 430 and/or main body 400. By enabling the removable alarm module 430 to be detached, it permits re-use of the alarm device even if the main body 400 or other (e.g., less expensive) portion of the security device is designed and allowed to be disposable (e.g., cut-off or otherwise damaged during its proper removal from the object). While the cost of the security device may be negligible, the cost of the active alarm module 430 may exceed the amount that a retailer is willing to spend on a disposable product.

Alarm module 430 may further be configured to activate when attached to a security device 300 such that detachment of the active alarm module 430 from the security device, without first applying the appropriate key, will trigger the module's alarm. In addition to or instead of the electrical contact triggering means, a mechanical switch can also be utilized to determine when the removable alarm module 430 is decoupled from main body 400. The mechanical means for activating the alarm of the removable alarm module 430 may include, for example, a plunger housed within the removable alarm module 430 that is depressed when the removable alarm module 430 is attached to the main body 400 and released when improperly detached from the main body 400. As used herein "plunger" includes any type of depression, pressure, and/or contact switch. The plunger may be made, at least partially, of a magnetically permeable material, which as used herein includes any magnetically sensitive material.

A key device (an example of which is shown in FIG. 18B) can be used to detach the removable alarm module 430 from the security device's main body 400. Such a key may be magnetic, for example, and may retain the plunger in the depressed position when applied to the security device. The key may also release the removable alarm module 430 from the main body 400 by releasing a magnetically sensitive latch, among other types of physical coupling components. The removable alarm module 430 is shown attached to the security device in FIG. 5. An example of a magnetically sensitive latch with a magnetic key release is shown in U.S. Pat. No. 7,497,101, which is incorporated herein in its entirety by reference, including column 8, lines 41-46, and FIGS. 3 and 4, which discuss some examples of the magnetically operable latching mechanism.

The alarm module 430 of the type described above may serve to provide at least two of the three-alarm protections over the secured object. A first alarm refers to the alarm that is emitted by the alarm module in response to a cable or other component being tampered with or severed. A second alarm refers to the alarm sounding by the security gates' alarm system, typically by the exit and/or other restricted area(s). A third alarm refers to the alarm that sounds by the removable alarm module 430's alarm system in response to the module determining it has entered or is about to enter a restricted area, such as within the vicinity of security gates, or for any other, non-tampering reason.

FIG. 6 shows a security device in accordance with other example embodiments of the present invention. The security device of FIG. 6 includes a main body 600 and cable portions 610 and 620. Each cable portion 610, 620 is configured to create a loop about an object that is to be secured. FIG. 6 illustrates the loops created by cable portions 610 and 620 without securing an object, though this is done for illustration purposes. The cable portions 610 and 620 may be formed of two individual cables or they may be formed of a single cable that is secured within the main body 600.

In embodiments using a single cable consistent with that shown in FIG. 6, a relative mid-point of the cable can be secured, permanently or semi-permanently, within the housing of the main body 600, which extends from two openings 640 to form the two cable portions 610 and 620. The main body 600 of FIG. 6 is shown at the front of a typical six-sided object, such as a rectangular box, wherein the object has a front, a back, and four sides. Each cable portion 610 and 620 is wound from the main body 600 on the front of the object around an adjacent side of the object. The cable portions cross each other at a point of the object back 605 before wrapping around the remaining sides and intersecting again at the main body 600. The cable portions 610 and 620 are inserted into the main body 600 whereupon they are secured, some examples of which are discussed herein. Excess cable may then be trimmed to provide a more pleasing aesthetic appearance.

FIG. 7 shows a cross-section of main body 600 of FIG. 6. The device of FIG. 7 shows the main body 600 of the security device without the cable portions 610 and 620. The securing inserts 650 and 660 are shown in FIG. 7 in the unlocked or unsecured position. The direction through which each cable portion 610 and 620 is fed, is shown by arrows 611 and 621, respectively. The cable passes freely through these channels when the securing inserts 650 and 660 are in the unsecured position. When the securing inserts 650 and 660 are moved to the secured position (in the direction of arrows 670), the cables are secured within the channels 611 and 621 at the desired length and cannot be moved within the main body 600 as discussed herein. FIG. 7 further shows an example of how the tapered channels 612 and 622, in which the securing inserts 650 and 660 are inserted, are tapered from a wider end in which the securing inserts are inserted to a narrower end.

FIG. 8 shows a securing insert consistent with the embodiments discussed in connection with, e.g., FIGS. 6 and 7. The securing insert 650 includes two arms 654 and 656 that each have opposing teeth 655. The securing insert 650 also includes a channel 652 through which the cable passes when the securing insert 650 is in the unsecured position. The first arm 656 is fixed relative to the position of the channel 652 when in the secured or unsecured position. The second arm 654 is pivotable relative to the channel 652 by the flexible hinge member 658. When a cable is inserted into the channel 652 and adjusted to the desired length around an object, the securing insert 160 can then be pressed into the tapered channel 612 shown in FIG. 7. The second arm 654 can then be urged toward the first arm 656 by the tapered channel and the teeth 655 to securely grip the cable and hold the cable firmly in position. In some embodiments, teeth 655 can be configured to establish an electrical connection with the cable, including removing any necessary insulation (such as a plastic sheath).

FIG. 9 shows the security device of FIGS. 6, 7, and 8 as attached and secured to an object. Cable loops 610 and 620 begin at opening 640 where the cable exits the main body 600 and terminate at the ends of the securing inserts, wherein the securing inserts are inserted into the main body 600, thereby securing the cable loops 610 and 620 at the desired length. The securing inserts are secured within the main body 600 by a detent that prevents removal without damaging or destruction of the security device. The cable ends may be trimmed at the exit of the securing devices 650 and 660 to prevent the exposure of loose cable with potentially sharp edges.

FIGS. 10-14C show another example security device, sometimes referred to herein as the "puck security device", which is consistent with some embodiments of the present invention. The housing of main body 1000 of the puck security device, like other housing components discussed herein, can comprise any type of material or combination of materials, including plastic, carbon fiber, metal, rubber, among other suitable options for various implementations. Main body 1000 is shown in FIG. 10 as incorporating a number of external features, including cable opening 1002, cable opening 1004, cable opening 1006, cable opening 1008, flanges 1010, locking recesses 1012 and holes 1014. Although four cable openings are shown in FIG. 10, two additional cable openings are incorporated into the opposite side of main body 1000 as shown in FIGS. 11B and 12A discussed below. Each of the exemplary external features shown in FIG. 10 can be combined with or replace other external features of other types of security devices, some of which are discussed herein, to enable main body 1000 to be physically coupled, electrically coupled and/or otherwise coupled (e.g., fiber optically coupled) to an object and/or a removable alarm module.

Cable opening 1002, cable opening 1004, cable opening 1006, cable opening 1008 and the two cable openings not shown in FIG. 10 are configured to allow a cable, similar to or the same as those discussed in connection with FIGS. 1-9, to pass through and secure main body 1000 to an object. For example, as shown in FIGS. 11A and 11B, cable 1102 can be comprised of one or two pieces cables that can be secured within the housing enclosure of main body 1000 or one piece of cable that passes through one or more cable conduits inside of main body 1000.

A first end of cable 1102, namely first end 1104, can exit main body 1000 through opening 1002. A second end of cable 1102, namely second end 1106, can exit main body 1000 through opening 1004. The ends of cable 1102 can then wrap around object 1108, enter main body 1000 through the two openings not shown in FIG. 10 or 11A, pass through a second and third internal cable conduit of main body 1000, and exit through openings 1006 and 1008, thereby securing the puck security device to object 1108. For example, first end 1104 can protrude through opening 1008 after passing through main body 1000, and second end 1106 can exit main body 1000 through opening 1006. If necessary and/or desired, the cable of some embodiments can be physically cut or otherwise trimmed, such that no excess portion of cable 1102 is left hanging, thus creating a less pleasing aesthetic appearance than that shown in FIG. 11B.

FIGS. 12A, 12B and 12C show some of the exemplary components that may be included inside main body 1000 when cable 1102 is a single piece of cable that is initially unsecured within main body 1000. Cable 1102 passes through curved conduit 1202, which runs between openings 1002 and 1004. Curved conduit 1202 can be configured such that both ends of cable 1102 exit main body 1000 perpendicular to each other. One skilled in the art would appreciate that curved conduit 1202 can cause the ends of cable 1002 to exit at any angle θ, including those greater than or less than the 90 degree θ shown in FIG. 12A.

As discussed above, after the ends of cable 1102 are wrapped around an object, the ends 1104 and 1106 are reinserted into openings of main body 1000. For example, second end 1106 can enter opening 1206, pass through conduit 1204, and exit main body 1000 through opening 1008. First end 1104 can enter opening 1212, pass through conduit 1210, and exit main body 1000 through opening 1006.

Within conduits 1204 and 1210, one or more locking mechanisms can be included to secure cable 1102 within the housing of main body 1000. In addition to or instead of the securing inserts discussed herein (see, e.g., FIGS. 7-9), pushnuts 1214 can be included in main body 1000 and used to exert a retention force onto both ends of cable 1102, thereby preventing cable 1102 from being pulled out of main body 1000 while it is secured (or should be secured) to an object.

FIG. 12B shows a detailed view of one of pushnuts 1214. Pushnuts 1214 can be comprised of any suitable material or combination of materials, including metal, plastics, and/or others. Although pushnutes 1214 are shown in the drawings as each having four locking plates, and each of the locking plates having six triangular locking teeth, one skilled in the art would appreciate than any number of locking plates using any number and/or shape of locking teeth can be used without departing from the spirit of the present invention. Similarly, more than one pushnut assembly, having varying or the same components, can be used in each conduit of main body 1000.

Main body 1000 can also include internal contacts 1216, detailed in FIG. 12C, which can be used to electrically couple main body 1000 to cable 1102. Interior contacts 1216 can be comprised of, for example, metal and/or any other electrically conductive material. As cable 1102 is inserted through conduit 1204 and/or conduit 1210, the force applied can also cause internal contact 1216 to strip any insulation from cable 1102 or otherwise cut into the insulation of cable 1102, thereby making electrical contact with the metallic portion of cable 1102.

One skilled in the art would appreciate that additional components, which are not shown in FIG. 12A, could be included in main body 1000. For example, an EAS tag or other circuitry could be integrated into main body 1000. Such circuitry may be passive, thereby lack a battery or other independent power source and be relatively inexpensive, enabling the puck security device to provide a passive security protection in a disposable form. For example, upon purchasing the object to which the puck security device is affixed, the cashier can use a wireless key device (an example of which is shown in FIG. 18B) to, e.g., electronically deprogram the circuitry inside the puck security device, thus allowing the puck security device to pass through EAS gates without alarming. As another example, a cashier's wireless key may read the unique identifier (or other information) from the puck security device's circuitry (via passive RFID or other known communication protocols), and then update a central database such that the central database will prevent an alarm from sounding in response to detecting that particular puck security device passing through the EAS gates. In the previous two examples, the customer could subsequently remove the puck security device using scissors or other cutting tool after leaving the store. As a third example, the cashier may simply cut the cable attaching the puck security device to the purchased object, push/pull the entire cable through the pushnuts 1214 and interior contacts 1216, discard the cut cable, and then reuse main body 1000 with a new cable to monitor another object.

Returning to FIG. 10, main body 1000 can also include one or more external features that facilitate its electro-mechanical coupling to a removable alarm module. For example, a mechanical fastening component or components, such as flanges 1010, can be configured to allow a removable module to be physically coupled to main body 1000. For example, flanges 1010 can be configured to allow a removable alarm module to twist onto the housing of main body 1000. Locking recesses 1012 can then be configured to enable the removable alarm module to lock in place. In some embodiments, a key may be required to unlock the removable alarm module from main body 1000. Holes 1014 can be included in the housing of main body 1000 such that holes 1014 align with interior contacts 1216. Flanges 1010 can be configured (e.g., angled, shaped, pitched, etc.) such that when the removable alarm module is physically attached to main body 1000, cable 1102 completes a circuit running through the removable alarm module.

For example, FIG. 13 shows removable alarm module 1302 being electro-mechanically coupled to a puck security device that includes main body 1000 and cable 1102, thereby securing alarm module 1302 to object 1108. For example, removable alarm module 1302 can be pushed down onto the puck security device, and rotated counterclockwise into an electro-mechanically coupled position. In this regard, the contacts of alarm module 1302 (discussed further in connection with FIGS. 14A and 14C) can be configured to protrude into holes 1014 and electrically couple with interior contacts 1216. The thread pitch of flanges 1010, in addition facilitating mechanical coupling, can be configured to ensure the contacts of alarm module 1302 will apply sufficient force onto interior contacts 1216 to establish a proper electrical connection. Additionally, locking pins, included in alarm module 1302, can be configured to move perpendicularly through a bottom portion of removable alarm module 1302 and into locking recesses 1012 when alarm module 1302 is properly positioned. To remove alarm module 1302 from main body 1000, an S3™ key, for example, can be applied to the top surface of alarm module 1302, causing the locking pins internal to alarm module 1302 to pull away from the main body 1000 (e.g., withdrawing out of locking recesses 1012), and allowing the module to rotate in clockwise motion freely.

FIGS. 14A-14C show various exploded and interior views of alarm module 1302 and example components that may be included therein. Alarm module 1302 can provide two-alarm functionality (utilizing an incorporated audio/visual alarm) and/or active alarm functionality (using, e.g., an incorporated independent power source), thereby enhancing passive and/or one-alarm functionality provided by a relatively-inexpensive passive security device affixed to an object. Additionally, in some embodiments, alarm module 1302 can be configured to provide tracking and other advanced functionality, some examples of which are discussed in commonly-assigned U.S. patent application Ser. No. 12/628,863 (titled "A Configurable Monitoring Device") and/or U.S. patent application Ser. No. 12/636,564 (titled "Systems, Methods, and Apparatuses for Managing Configurable Monitoring Devices), which are hereby incorporated in their entirety.

Housing 1400 of alarm module 1302 is shown in FIG. 14A as including two pieces, namely cover 1402 and ring 1404. As discussed herein, housing 1400 can be made of any suitable material or combination thereof and serve as a protective enclosure for the internal components of alarm module 1302. Ring 1404 can also be configured to function as a mechanical coupling component, thereby enabling alarm module 1302 to be physically connected to an object via main body 1000. For example, notches or other type of physical receptacle designed for receiving flanges 1010 can be incorporated into ring 1404. Although flanges 1010 and receptacles included in ring 1404 can be used to attach main body 1000 with alarm module 1302 in a screw-like fashion, one skilled in the art would appreciate that any type of mechanical attaching mechanism and/or component can be used. For example, alarm module 1302 can slide onto main body 1000, rotate on main body 1000 along a horizontal axis, or follow a track incorporated in main body 1000, just to name a few alternatives.

Within housing 1400, alarm module 1302 can include, for example, ferrite 1406, circuit board 1408, independent power source 1410, piezo audio alarm 1412, locking pins 1414, electrical contacts 1416, which protrude through bottom 1418. In some embodiments, bottom 1418 can be considered part of housing 1400 and be configured to protect alarm module 1302's internal components.

Ferrite 1406 can be used in some embodiments to determine when alarm module 1302 is within a broadcast range of, for example, an EAS gate. As such, ferrite 1406 can activate in response to determining it is within range of an EAS gate and send a corresponding signal (e.g., logical 1) to circuit board 1408. Circuit board 1408 can include, for example, a printed circuit and/or any other type of circuit and control the functionality alarm module 1302 and/or a security device to which alarm module 1302 is coupled. Circuit board 1408 can be screwed to or otherwise affixed to bottom 1418 and/or electrical contacts 1416 can be used to physically couple circuit board 1406 to bottom 1418. In some embodiments, ferrite 1406 and/or piezo audio alarm 1412 can also be physically coupled to bottom 1418.

Circuit board 1408 and/or the other active components of alarm module 1302 can be powered by independent power source 1410. Independent power source 1410 can include, for example, a battery. As used herein, an independent power source includes any source of power that is generated absent another device or system. For example, a passive, ultra-high frequency RFID tag would be considered as lacking an independent power source if it derives its power parasitically from wireless energy emitted by an interrogating device.

The circuitry of alarm module 1302, also shown in FIG. 14B, can be configured to activate piezo audio alarm 1412 and/or a visual alarm indicator (not shown) in response to receiving one or more inputs indicating the occurrence of one or more triggering events being detected. For example, ferrite 1406 entering an active state can serve as an alarm triggering event. As another example, one or more other wireless communication components (not shown) may be coupled to or integrated into circuit board 1408 and the alarming, tracking and locating functionality discussed in previously-incorporated, commonly-assigned U.S. patent application Ser. No. 12/628,863 (titled "A Configurable Monitoring Device") and/or Ser. No. 12/636,564 (titled "Systems, Methods, and Apparatuses for Managing Configurable Monitoring Devices), may be implemented.

Locking pins 1414 are shown in FIG. 14A as being spring-loaded. In some embodiments, the material of the pin portion is attracted to a magnet. The springs of locking pins 1414 can then be chosen or otherwise configured to be strong enough to physically prevent alarm module 1302 from unauthorized removal from main body 1000, while being unable to withstand a particular magnetic force generated by a wireless key used to unlock locking pins 1414 from their engagement with main body 1000. For example, in response to a (relatively strong) magnet having (e.g., a particularly-shaped) magnetic field being placed above locking pins 1414, the bottom portion of locking pins 1414 may be attracted to the magnet, thereby compressing the springs and unlocking alarm module 1302 from main body 1000.

According to some exemplary aspects of embodiments of the present invention, the processor included on circuit board 1408 may operate under control of a computer program product. For example, the memory can also be included on circuit board 1408, and be configured to store firmware, one or more application programs, and/or other software that is executed by the processor to control the operation of alarm module 1302, main body 1000, the entire puck security device, and/or a remote device. The computer program product for directing the performance of one or more functions of exemplary embodiments of the processor includes a computer-readable storage medium, such as a non-volatile storage medium and software (including computer-readable program code portions), such as a series of computer instructions are embodied in the computer-readable storage medium of circuit board 1408.

As will be appreciated, any such computer program instructions may be loaded onto a remote computer or other programmable apparatus included on circuit board 1408, to produce a machine, such that the instructions which execute on the computer or other programmable apparatus (e.g., hardware) create means for implementing the functions described herein. These computer program instructions may also be stored in a computer-readable memory that may direct a computer or other programmable apparatus (integrated, e.g., onto circuit board 1408) to function in a particular manner, such that the instructions stored in the computer-readable memory produce an article of manufacture including instruction means which implement the functions described herein. The computer program instructions may also be loaded onto a computer or other programmable apparatus to cause a series of operational steps (including those described in connection with, e.g., FIG. 21) to be performed on the computer or other programmable apparatus to produce a computer-implemented process.

Circuit board 1408 can also be electrically coupled to electrical contacts 1416. In some embodiments, electrical contacts 1416 can be used to couple to cable 1102 (discussed above). Circuit board 1408's circuitry can be configured to output a signal (analog or digital) to one of electrical contacts 1416 ("output contact") and monitor the other of electrical contacts 1416 ("input contact") for the same signal. Should, for example, no signal arrive at the input contact, the circuitry of alarm module 1302 can be configured to alarm. A lack of an expected input signal may indicate, e.g., that cable 1102 has been tampered with or damaged, alarm module 1302 has been tampered with or damaged (e.g., is no longer properly coupled to main body 1000), and/or the security device has been tampered with or damaged.

In other embodiments, rather than electrical contacts 1416 being configured to function as input/output ports, electrical contacts 1416 can both be configured as input ports or output ports, or switch among the two. For example, in embodiments such as a security device lacking a cable and instead including one or more pressure switches and/or a pin mounting components, both electrical contacts 1416 can be configured to be inputs to the circuitry of alarm module 1302. In the event a signal is received from one or more of electrical contacts 1416, the circuitry can be configured to determine that a pressure switch has been triggered due to a product being prematurely removed from the packaging (e.g., before the security device had been removed from the product or its packaging) and/or as a result of tampering or damage caused to the object being secured and/or tracked.

In some embodiments, bottom 1418 can be sandwiched between cover 1402 and ring 1404, such that bottom 1418 (and the components affixed thereto) can rotate freely within housing 1400. For example, locking pins 1414 are also trapped between cover 1402 and ring 1404, and can be configured to remain stationary relative to cover 1402 and ring 1404. To accommodate locking pins 1414 remaining stationary while cover 1402 and ring 1404 rotate, slots 1420 can be incorporated into bottom 1418 as shown in FIGS. 14B and 14C. In this regard, electrical contacts 1416 can be placed into holes 1014 of main body 1000, and alarm module 1302 can be twisted until locking pins 1414 lock into locking recesses 1012, thereby mechanically and electrically securing alarm module 1302 to main body 1000.

In some embodiments, one or more components discussed herein can be combined or omitted without departing from the spirit of the present invention. For example, ferrite 1406 can be omitted from alarm module 1302. In some embodiments, alarm module 1302's circuitry can be configured to receive an input from a passive wireless component incorporated into, e.g., main body 1000.

FIGS. 15A-18B show another example of a puck security device, which is consistent with some embodiments of the present invention. Features and other elements that are the same as those discussed above include like reference numerals in the drawings.

One difference of the puck security device shown in FIG. 15A (as compared to those discussed above) is the housing of main body 1500 includes crescent holes 1502. Holes 1502 can be included in the housing of main body 1500 such that holes 1502 align with interior contacts 1602 shown in FIGS. 16A and 16B. Interior contacts 1602, can be used to electrically couple main body 1500 to cable 1102. Interior contacts 1602 can be comprised of, for example, metal and/or any other electrically conductive material. As cable 1102 is inserted through conduit 1204 and/or conduit 1210, the force applied can also cause internal contact 1602 to strip any insulation from cable 1102 or otherwise cut into the insulation of cable 1102, thereby making electrical contact with the metallic portion of cable 1102.

FIG. 15B shows removable alarm module 1504 being electro-mechanically coupled to a puck security device that includes main body 1500 and cable 1102, thus securing alarm module 1504 to object 1108. For example, removable alarm module 1504 can be placed onto the puck security device, and rotated counterclockwise into an electro-mechanically coupled position. In this regard, the contacts of alarm module 1504 (discussed further in connection with FIG. 17) can be configured to protrude into holes 1502 and electrically couple with interior contacts 1602 shown in FIGS. 16A and 16B. For example, as alarm module 1504 screws onto flanges 1010, the contacts of alarm module 1504 can slide through crescent shaped holes 1502 and across the top face of interior contacts 1602. As such, the contacts of alarm module 1504 can wipe away and otherwise clean interior contacts 1602 of dirt and other material that may negatively impact electrical coupling. The crescent shape of holes 1502 and interior contacts 1602 are sometimes referred to herein as main body 1500 being adapted to have a module contact swipe through and across for a more reliable transfer of power in some types of applications.

One skilled in the art would appreciate that, consistent with the discussion above, additional components that are not shown in FIG. 16A may be included in main body 1500. For example, an EAS tag or other circuitry could be integrated into main body 1500. Such circuitry may be passive, thus lacking a battery or other independent power source and being relatively inexpensive, while still enabling the puck security device to provide passive security protection in a disposable form. For example, upon purchasing the object to which the puck security device is affixed, the cashier can use a wireless key device (an example of which is shown in FIG. 18B) to, e.g., electronically deprogram the circuitry inside the puck security device, thereby allowing the puck security device to pass through EAS gates without alarming. As another example, a cashier's wireless key may read the unique identifier (or other information) from the puck security device's circuitry (via passive RFID or other known communication protocols, including those using AM frequency wavelengths), and then update a central database such that the central database will prevent an alarm from sounding in response to detecting that particular puck security device passing through the EAS gates. In the previous two examples, the customer could subsequently remove the puck security device using scissors or other cutting tool after leaving the store. As a third example, the cashier may simply cut the cable attaching the puck security device to the purchased object (e.g., object 1108), push/pull the entire cable through the pushnuts 1214 and interior contacts 1602, discard the cut cable, and then reuse main body 1500 with a new cable to monitor another object.

FIG. 17 shows various exploded and interior views of alarm module 1504 and example components that may be included therein. Similar to alarm module 1302, alarm module 1504 can provide two-alarm functionality (utilizing an incorporated audio/visual alarm) and/or active alarm functionality (using, e.g., an incorporated independent power source), thereby enhancing passive and/or one-alarm functionality provided by a relatively-inexpensive passive security device affixed to an object. Additionally, in some embodiments, alarm module 1504 can be configured to provide tracking and other advanced functionality, some examples of which are discussed in commonly-assigned U.S. patent application Ser. No. 12/628,863 (titled "A Configurable Monitoring Device") and/or U.S. patent application Ser. No. 12/636,564 (titled "Systems, Methods, and Apparatuses for Managing Configurable Monitoring Devices), which are hereby incorporated by reference in their entirety.

The housing of alarm module 1504 is shown in FIG. 17 as including two pieces, namely cover 1702 and bottom 1704. Cover 1702 and bottom 1704 can be coupled together using, for example, known ultrasonic welding methods. Bottom 1704 can be configured to function as an attaching component.

A difference between alarm module 1504 and alarm module 1302 is that alarm module 1504 lacks a component similar to or the same as ring 1404. Rather, circuit board 1408 can be physically coupled to either (or both) of cover 1702 or bottom 1704. Similarly, electrical contacts 1416 can be embedded into or otherwise physically attached to bottom 1704 and/or any other portion of alarm module 1504. As such, electrical contacts 1416 of alarm module 1504 can rotate with (instead of independent from) the housing of alarm module 1504. Likewise, locking pins 1414 and the other internal components of alarm module 1504 may be incorporated into alarm module 1504 in a manner that all the components rotate with the housing of alarm module 1504. Locking holes 1706 can be included in bottom 1704 to allow locking pins to extend out of and retract into bottom 1704.

Locking pins 1414, like those discussed in connection with FIG. 14A, are shown in FIG. 17 as being spring-loaded and adapted to protrude perpendicularly through a bottom portion of alarm module 1504. When alarm module 1504 is attached to main body 1500, as shown in FIG. 18A, the springs of locking pins 1414 can exert a locking force that, for example, prevents alarm module 1504 from being unscrewed from main body 1500. In response to key 1800, shown in FIG. 18B, being placed over alarm module 1504, the springs of locking pins 1414 may compress, thereby unlocking alarm module 1504 from main body 1000. For example, a magnet incorporated in key 1800 can pull locking pins 1414 towards cover 1702. In this regard the magnet of key 1800 can be adapted to be strong enough to cause springs 1414 to compress. In some embodiments, the key can include a receptor or other type of surface contour (not shown) that is configured to receive flat surface 1802 of alarm module 1504. In this manner, the magnet(s) of key 1800 can be properly aligned to attract locking pins 1414 of alarm module 1504. The receptor of key 1800 can also assist a user in unscrewing alarm module 1504 off of main body 1500.

FIGS. 19A-20D show another example of an alarm module attached to a puck security device, which is consistent with some embodiments of the present invention. Features and other elements that are the same as or substantially similar to those discussed herein include like reference numerals.

Puck device 1900 can be adapted to attach to object 1108 and receive removable alarm module 1902. In this manner, removable alarm module 1902, which like embodiments of some other removable modules discussed herein, may lack any mechanism to attach directly to a retail or other type of article, but can be attached indirectly to object 1106 by means of puck device 1900 or any other kind of device.

Removable alarm module 1902 is shown as including locking component 1904, which includes locking button 1906. Locking component 1904 can be used in addition to or instead of locking pins 1414 discussed above. Locking button 1906 can be a physical button adapted to protrude from the side of locking component 1904 when locking component 1904 is disarmed. Locking component 1904 may also be physically unlocked while disarmed, thereby enabling removable alarm module 1902 to be detached from main body 1900. Among other benefits, locking button 1906 also visually indicates if locking component 1904 is locked.

In response to removable alarm module 1902 being rotated onto puck device 1900, locking component 1904 can be armed. When armed, locking component 1904 can electromechanically lock removable alarm module 1902 onto puck device 1900. For example, the rotating motion may automatically activate the alarming system (which may be similar to those discussed elsewhere herein), while physically locking onto puck device 1900. As another example, button 1906 may have to be manually depressed, subsequent to or while twisting removable alarm module 1902 into position, to arm locking component 1904.

FIGS. 20A-20D show, among other things, exemplary internal components of locking component 1904. For example, locking component 1904 can include locking spring 2002, switch 2004, locking protrusion 2006 and stop mechanism 2010. Locking spring 2002 can be compressed when locking component 1904 is armed. In response to a key being applied (such as a key discussed above), the force of locking spring 2002 can cause locking component 1904 to be physically unlocked. Locking spring 2002 can include magnetically permeable material that can be magnetically unlocked by, for example, a key or other type of device being placed in proximity to (e.g., over the top of) locking component 1904.

Switch 2004 can be electrically coupled to the other circuitry included on circuit board 1408. Switch 2004 can detect, for example, if removable alarm module 1902 is improperly disconnected from puck device 1900. An improper disconnection may include, e.g., removable alarm module 1902 being removed from puck device 1900 without first being properly disarmed by means of a key and/or other device. For example, when locking component 1904 is locked in place, button 1906 causes switch 2004 to depress and removable alarming module 1902's alarming functionality can be activated. When button 1906 is properly disengaged (with, e.g., a magnetic key), switch 2004 can be released and the electronics on circuit board 1408 can deactivate. Although switch 2004 is shown in FIGS. 20A-20D as being a pressure switch with an electrical output coupled to circuit board 1408, additional and/or alternative embodiments may also be included in removable alarm module 1902. For example, switch 2004 may include, for example, one or more electrical contacts that enables the circuitry of removable alarm module 1902 to determine whether or not locking component 1904 is properly armed (e.g., button 1906 depressed and slide bar locked). For example, locking component 1904 can include an electrically conductive lateral locking protrusion (discussed below) or other type of slide bar that is coupled to the circuitry on circuit board 1408 when in the locked position.

FIGS. 20C and 20D show locking protrusion 2006 in the locked and unlocked positions. When in the locked position, locking protrusion 2006 fits into locking recess 2008 incorporated in puck device 1900. In this regard, puck device 1900 can be adapted to receive and facilitate mechanical coupling with removable alarm module 1902. Locking protrusion 2006 can be released and, as a result, move in a laterally relative to, e.g., a bottom portion of the alarm module, similar to the movement of button 1906. While released, locking protrusion 2006 is away from the main body of puck device 1900, allowing removable alarm module 1902 to rotate off of (or onto) puck device 1900.

Puck device 1900 may function otherwise the same as or substantially similar to any other puck device discussed herein. Similarly, removable alarm module 1902 may otherwise function the same as or substantially similar to any other removable alarm module discussed herein.

FIG. 21 shows process 2100, which includes an example machine-implemented process that can be employed by circuitry of an alarm module, such as alarm module 1302, alarm module 430, or any other type of device in accordance with embodiments of the present invention. Process 2100 shows a process related to decisions alarm module circuitry may make in connection with the operating mode or modes of the alarm module. Process 2100 starts at 2102.

At 2104, the alarm module waits in a power saving mode. While in the power saving mode (e.g., powered OFF, in stand-by, etc.), the alarm module circuitry can be configured to periodically check for a triggering event or wait for an awake signal (caused by, e.g., a power button being depressed, etc.).

At 2106, the circuitry determines whether the alarm modules electrical contacts are coupled to another device, such as the main body of a passive alarm security device. Although the Spider Wrap® security devices are often used in the examples provided herein, one skilled in the art would appreciate that any type of passive alarm security device, including pin-based security devices (for protecting articles of clothing), bottle lock security devices (for protecting bottles), a keeper or plastic enclosure security device (for protecting compact disks, software, cologne, and the like), among others, can also be electrically and mechanically coupled to an active, two-alarm module implementing embodiments of the present invention.

In response to determining at 2106 that the alarm module's electrical contacts are uncoupled, process 2100 can return to 2104 and the alarm module can enter the power saving mode.

In response to determining at 2106 that the alarm module's electrical contacts are coupled to another device, the circuitry of the alarm module can begin initiating, at 2108, a relatively more power consuming operation of the alarm module.

Next, a determination is made at 2110 as to whether or not the electrical contacts of the alarm module are coupled to a passive security device. This determination can be made based upon, for example, any signal the device is generating and sending to the alarm module's electrical contacts and/or based upon how the device responds to one or more signals generated by the alarm module and sent to the device via one or more of the electrical contacts. For example, a passive security device can be configured to simply route a signal from the alarm module's output electrical contact to the alarm module's input electrical contact. In this regard, any signal (whether it be analog or digital) outputted by the alarm module should be nearly instantaneously received by the alarm module.

In response to determining at 2110 that the alarm module is not coupled to a passive security device, but instead electrically coupled to something else, a determination can be made as to what type of device it is coupled to. For simplicity of this disclosure, only one example of such devices is shown in FIG. 21, namely a charging device, but one skilled in the art would appreciate that a number of different types of devices could be coupled (wirelessly or otherwise) to the alarm module and that communications could be established between the alarm module and those devices.

At 2112, a determination is made by the alarm module as to whether its electrical contacts are connected to an independently powered device. In some embodiments, this type of determination can be used to determine whether or not the device is a battery charger. In other embodiments, more sophisticated authentication protocol can be implemented using, for example, particular voltages and/or ramp up algorithms to determine first whether the device is a battery charging device and second whether the device is authorized to charge the particular alarm module (or type of alarm module).

In response to determining at 2112 that the alarm module is connected to an independently powered device, the alarm module begins, at 2114, to charge its independent power source from the charge of the independently powered device. The alarm module can also be configured to monitor its charging process to, e.g., avoid over heating its battery, and at 2116 make a decision as to whether it has been fully charged or disconnected. In response to determining it is still connected and/or not fully charged, process 2100 returns to 2114 and the charging of the alarm module's power source continues.

In response to determining at 2116 that the alarm module has been disconnected or has been fully charged, process 2100 can return to 2104 and the alarm module can enter a power-saving mode. Similarly, in response to determining at 2112 that the alarm module is not connected to an independently powered device (which is also not a passive security device as previously determined at 2110), process 2100 can return to 2104.

Process 2100 can proceed to 2118 in response to determining at 2110 that the alarm module is coupled to a passive security device using, e.g., the methods noted above. Upon being coupled to a passive security device, the alarm module can begin performing active alarm monitoring at 2118. Active alarm monitoring, as referenced herein, involves alarm monitoring and alerting requiring an independent power source (e.g. battery) and integrated alarm output circuitry (e.g., visual and/or audio alarm, wireless communications circuitry to report an alarm condition, etc.).

At 2120, the alarm module determines whether it has detected tampering to the object being secured, the security device, the alarm module, or any other component it is designed to protect. At 2120, the alarm module can also monitor, among other alarm conditions, unauthorized removal of the security device from the object and/or the unauthorized removal of the alarm module from the passive security device. Authorized removal may require, for example, the use of a key, passcode, physical location determination, etc.

In response to detecting at 2120 a lack of tampering or unauthorized removal, a determination can be made that there is no alarm condition and there has been no triggering event, and process 2100 can proceed to 2122. At 2122, a determination is made as to whether the alarm module has properly decoupled from the passive security device and, if so, process 2100 proceeds to 2104. If not, process 2100 returns to 2118 and continues to perform active monitoring for an alarm condition and/or triggering event.

In response to determining at 2120 that an alarm condition is present and/or alarm triggering event has occurred, process 2100 proceeds to 2124 and one or more alarms are activated. Process 2100 then ends at 2126.

Many modifications and other embodiments of the inventions set forth herein will come to mind to one skilled in the art to which these inventions pertain having the benefit of the teachings presented in the foregoing descriptions and the associated drawings. For example, one or more buttons, such as the button shown FIGS. 19-20 as being adapted for a lateral movement locking bar, may be adapted to protrude through the top of a removable alarm module and be coupled to a vertically moving locking pin, such as those discussed in connection with, e.g., FIG. 17. As another example, a switch, similar to or the same as that shown in FIGS. 19-20 may also be incorporated into other embodiments discussed herein. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A device structured for attachment to an object, the device comprising:

a loop comprising electrically conductive material configured to be wrapped around the object; and a main body comprising:

at least one contact electrically connected to the loop, wherein the main body is configured to be secured to the object via the loop;

an EAS component having an excited state and an unexcited state; and an attaching mechanism configured to receive an alarm module;

wherein the alarm module is configured to be locked and unlocked from the main body;

wherein the at least one contact of the main body is configured to electrically couple with a respective complementary contact of the alarm module in an instance in which the alarm module is locked to the main body;

wherein the alarm module includes an alarm mechanism configured to activate at least one alarm response;

wherein the alarm module comprises an antenna configured to detect the excited state of the EAS component of the main body; and wherein the alarm mechanism is further configured to activate the at least one alarm response upon detection by the antenna of the excited state of the EAS component.

2. The device of claim 1, wherein the main body further comprises a locking mechanism that secures the loop within the main body.

3. The device of claim 1, wherein the alarm module includes an independent power source.

4. An alarm module, comprising:

a housing, wherein the housing is configured to be locked and unlocked from a main body via an attaching mechanism between the housing and the main body, the main body being configured to be secured to an object to be protected via a loop comprising electrically conductive material that is configured to be wrapped around the object, the main body comprising an EAS component having an excited state and an unexcited state;

an antenna configured to detect the excited state of the EAS component; and circuitry comprising:

an alarm mechanism configured to activate at least one alarm response; and at least one contact configured to electrically couple with a respective complementary contact of the main body in an instance in which the housing is locked to the main body, wherein the complementary contact of the main body is electrically connected to the loop;

wherein the alarm mechanism is configured to activate the at least one alarm response upon each of (a) detection by the antenna of the excited state of the EAS component; (b) the housing being decoupled from the main body without a key being applied, and (c) the loop being severed.

5. The alarm module of claim 4, wherein the circuitry is mounted within the housing.

6. The alarm module of claim 4, wherein the circuitry is mounted on an electronics subassembly between a top portion of the housing and a bottom portion of the housing, wherein the electronics subassembly is configured to rotate independently from the housing.

7. The alarm module of claim 6, wherein the at least one contact rotates with the electronics subassembly.

8. The alarm module of claim 4 further comprising a locking mechanism configured to mechanically lock the alarm module to the main body.

9. The alarm module of claim 8, wherein the locking mechanism is configured to rotate with the housing.

10. The alarm module of claim 8, wherein the locking mechanism includes a spring biased to a locked position, wherein the spring comprises a ferrite material, wherein the spring is configured to retract from the locked position in an instance in which a key with a magnet is located proximate the spring.

11. The alarm module of claim 8, wherein the locking mechanism includes a spring-loaded pin that is configured to move perpendicularly through a bottom portion of the alarm module.

12. The alarm module of claim 8, wherein the locking mechanism includes a sliding protrusion that is configured to move laterally relative to a bottom portion of the alarm module.

13. The alarm module of claim 8, wherein the locking mechanism comprises a physical button.

14. The alarm module of claim 8, wherein the locking mechanism comprises a switch.

15. The alarm module of claim 4, wherein the circuitry is further configured to receive an input from the main body.

16. The alarm module of claim 15 wherein the alarm mechanism is configured to activate the at least one alarm response in response to receiving the input from the security device.

17. The alarm module of claim 4, wherein the at least one contact comprises a first contact and a second contact, and wherein the first and second contacts are each configured to electrically couple with respective complementary contacts of the main body in an instance in which the housing is locked to the main body.

18. The device of claim 1, wherein the at least one contact comprises a first contact and a second contact, wherein the first and second contacts are each configured to electrically couple with respective complementary contacts of the alarm module in an instance in which the alarm module is locked to the main body.

19. The device of claim 1, wherein the loop of electrically conductive material comprises a cable.

20. The alarm module of claim 4, wherein the loop comprises a cable.

21. The device of claim 1, wherein the at least one electrical contact of the main body is located on an exposed surface of the main body, and the complementary contact of the alarm module is located on an exposed surface of the alarm module.

22. The device of claim 1, wherein the at least one electrical contact of the main body and the complementary contact of the alarm module are configured to be brought (1) into surface contact when the alarm module is locked to the main body and (2) out of surface contact when the alarm module is unlocked and removed from the main body.

23. The device of claim 1, wherein the alarm mechanism is further configured to prevent the alarm from activating in response to the alarm module being decoupled from the main body when a key is applied.

24. A security apparatus for attachment to an object, the apparatus comprising:

a main body comprising (1) an attaching mechanism, (2) at least one contact located on an exposed surface of the main body, and (3) an EAS component having an excited state and an unexcited state;

a loop coupled to the main body, the loop comprising electrically conductive material configured to be wrapped around the object to secure the main body to the object, the loop electrically connected to the contact of the main body;

an alarm module configured to activate at least one alarm response, the alarm module comprising (1) at least one contact located on an exposed surface of the alarm module and (2) an antenna configured to detect the excited state of the EAS component;

the alarm module further configured to activate the at least one alarm response upon detection by the antenna of the excited state of the EAS component;

the alarm module further configured to be alternated between: (1) a locked state in which the alarm module is locked to the main body and the contact of the main body is electrically coupled with the contact of the alarm module; and (2) an unlocked state in which the alarm module can be removed from the main body without activating the at least one alarm response;

the alarm module being alternated from the locked state to the unlocked state in response to a key; and the alarm module further configured to: (1) activate the at least one alarm response upon the alarm module being removed from the main body in the locked state; and (2) activate the at least one alarm response upon the loop being severed in the locked state.

* * * * *